US011340037B1

(12) United States Patent
Chia et al.

(10) Patent No.: US 11,340,037 B1
(45) **Date of Patent: *May 24, 2022**

(54) EASY LOADING TOY PROJECTILE LAUNCHER

(71) Applicant: Easebon Services Limited, Kwun Tong (HK)

(72) Inventors: Francis See Chong Chia, Kowloon (HK); Steven J. Huebl, Jordon, MN (US)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/219,149

(22) Filed: Mar. 31, 2021

Related U.S. Application Data

(63) Continuation-in-part of application No. 16/951,379, filed on Nov. 18, 2019, now Pat. No. 11,215,420,
(Continued)

(51) Int. Cl.
*F41B 7/08* (2006.01)
*F41B 4/00* (2006.01)
(Continued)

(52) U.S. Cl.
CPC ..... *F41B 4/00* (2013.01); *F41B 7/08* (2013.01); *F42B 6/08* (2013.01)

(58) Field of Classification Search
CPC .... F41B 4/00; F41B 7/006; F41B 7/08; F41B 11/50; F41B 11/52; F41B 11/53;
(Continued)

(56) References Cited

U.S. PATENT DOCUMENTS 2,735,206 A * 2/1956 Butler et al. ..... F41A 9/65 42/50
2,753,977 A 7/1956 Ransohoff
(Continued)

FOREIGN PATENT DOCUMENTS

CN 208026132 U 10/2018
GB 616909 A 1/1949
(Continued)

OTHER PUBLICATIONS

International Search Report received for PCT Patent Application No. PCT/SG2021/050248 dated Jul. 30, 2021, 5 pages.
(Continued)

*Primary Examiner* — Alexander R Niconovich
(74) *Attorney, Agent, or Firm* — Amster, Rothstein & Ebenstein LLP

(57) ABSTRACT

A toy projectile launcher for launching projectiles, e.g, toy foam darts, from a detachable hopper. An agitating member inside the hopper enables the orderly descent of the projectiles within the hopper. A hopper cover has a collapsible ceiling with nested members and a ceiling plate to maintain the projectiles toward the bottom of the hopper. First and second catches coupled to the ceiling plate respectively engage openings in hopper walls to prevent the ceiling plate from collapsing into the cover when the hopper cover is closed. Where there are multiple vertically-spaced-apart openings in the hopper walls, the first and second catches may disengage from respective first openings, and then engage lower, second openings in the hopper walls, as the number of projectiles in the hopper drops and the ceiling plate descends in the hopper. A rotating gear advances projectiles from the firing chamber to flywheels for launch.

45 Claims, 37 Drawing Sheets

Related U.S. Application Data which is a continuation of application No. 16/843,337, filed on Apr. 8, 2020, now Pat. No. 10,871,343, which is a continuation of application No. 15/991,683, filed on May 29, 2018, now Pat. No. 10,648,767, which is a continuation-in-part of application No. 15/850,130, filed on Dec. 21, 2017, now Pat. No. 10,648,763.

(51) Int. Cl.
*F41B 11/53* (2013.01)
*F42B 6/08* (2006.01)

(58) Field of Classification Search
CPC ..... F41B 11/54; F41B 11/55; F41B 11/89; F41A 9/00; F41A 9/01; F41A 9/02
USPC ..... 124/45, 49, 51.1, 52, 78; 446/473
See application file for complete search history.

(56) References Cited

U.S. PATENT DOCUMENTS 3,191,588 A 6/1965 Thew
3,348,531 A 10/1967 Yano
4,168,695 A 9/1979 Haller et al.
4,756,297 A * 7/1988 Sindel ..... F41B 11/642 124/67
4,843,751 A * 7/1989 Ferri ..... F41B 11/55 124/67
5,282,454 A 2/1994 Bell et al.
5,373,832 A 12/1994 Bruce
5,511,333 A 4/1996 Farrell
5,515,837 A 5/1996 Nin et al.
5,522,374 A 6/1996 Clayton
5,794,606 A * 8/1998 Deak ..... F41B 11/57 89/33.17
6,327,953 B1 * 12/2001 Andresen ..... F41B 11/57 89/33.02
6,408,837 B1 6/2002 Johnson et al.
6,415,781 B1 * 7/2002 Perrone ..... F41B 11/57 124/49
6,467,473 B1 * 10/2002 Kostiopoulos ..... F41B 11/53 89/33.17
6,481,432 B2 11/2002 Rushton et al.
6,488,019 B2 12/2002 Kotsiopoulos
6,609,511 B2 * 8/2003 Kotsiopoulos ..... F41B 11/57 124/51.1
6,644,293 B2 * 11/2003 Jong ..... F42B 39/02 124/52
6,889,680 B2 * 5/2005 Christopher ..... F41B 11/53 124/52
6,915,792 B1 7/2005 Sheng
6,957,645 B1 * 10/2005 Cross ..... F41B 11/53 124/51.1
6,981,493 B1 1/2006 Poteracke
7,051,727 B2 5/2006 Wu
7,077,118 B2 7/2006 Lewis
7,222,617 B2 * 5/2007 Andresen ..... F41A 9/02 124/52
7,234,456 B2 * 6/2007 Andresen ..... F41A 9/02 124/48
7,270,121 B2 * 9/2007 Lubben ..... F41B 11/53 124/51.1
7,322,348 B2 * 1/2008 Chen ..... F41B 11/53 124/51.1
7,426,927 B1 9/2008 Broersma
7,441,556 B2 10/2008 Friesen et al.
7,568,478 B2 * 8/2009 Hedberg ..... F41B 11/53 124/51.1
7,640,924 B2 1/2010 Cherepanov
7,770,569 B2 * 8/2010 Andresen ..... F41A 9/02 124/51.1
8,021,208 B2 9/2011 Victor
8,047,190 B2 * 11/2011 Kaakkola ..... F41B 11/57 124/1
8,235,030 B2 8/2012 Kaakkola et al.
8,353,277 B2 * 1/2013 Huebl ..... F41A 9/72 124/78
8,402,959 B1 * 3/2013 Nungester ..... F41B 11/53 124/51.1
8,596,254 B2 12/2013 Brooks et al.
8,596,255 B2 * 12/2013 Meggs ..... F42B 6/10 124/56
8,695,579 B2 4/2014 Huebl
8,776,693 B2 7/2014 Toeckes et al.
9,027,541 B2 5/2015 Huebl
9,212,864 B2 12/2015 Christopher et al.
9,255,749 B2 2/2016 Faifer
9,557,136 B2 * 1/2017 Hedberg ..... F41B 11/53
9,658,027 B2 5/2017 Stevens
9,958,230 B1 * 5/2018 Nugent ..... F41A 9/65
10,072,905 B2 9/2018 Skupin
2002/0081939 A1 6/2002 Hornsby et al.
2002/0166551 A1 11/2002 Les
2003/0136795 A1 7/2003 Juan
2005/0252500 A1 11/2005 Morikawa et al.
2005/0274371 A1 12/2005 Lubben
2007/0012304 A1 1/2007 van Dorsser
2007/0056573 A1 3/2007 Campo
2010/0095942 A1 4/2010 Kaakkola et al.
2011/0067681 A1 3/2011 Stevens et al.
2011/0271941 A1 11/2011 Meggs
2012/0037138 A1 2/2012 Huebl
2012/0103316 A1 5/2012 Kaakola et al.
2012/0285434 A1 11/2012 Andersen
2013/0112184 A1 * 5/2013 Corsiglia ..... F42B 6/00 124/78
2014/0283809 A1 9/2014 Huebl
2021/0102769 A1 * 4/2021 DeRoche ..... F42B 6/00

FOREIGN PATENT DOCUMENTS

GB 2200899 A 8/1988
GB 2 206 055 A 12/1988
JP 2003-322496 A 11/2003

OTHER PUBLICATIONS

Written Opinion received for PCT Patent Application No. PCT/SG2021/050248 dated Jul. 30, 2021, 7 pages.
Bridge Breaker Flow Aid, Thayer Scale, http:www.thayerscale.com/producUbridge-breakers-bin-discharger/, printed Sep. 25, 2017 (3 pp).
Warpig Reloader 2, warpig.com, http:l/www.warpig.com/paintball/technical/loaders/reloader2/, printed Sep. 25, 2017 {5 pp).
IBC Discharge Unit, Direct Industry, http://www.directindustry.com/prod/mucon/product-111125-1093699.html, printed D9/25/2O17 (8 pp).
Office Action, dated Dec. 31, 2018, in U.S. Appl. No. 15/850,130, 10 pp., United States Patent & Trademark Office.

* cited by examiner

EASY LOADING TOY PROJECTILE LAUNCHER

CROSS-REFERENCE TO RELATED APPLICATION

This application is a continuation-in-part of and claims the benefit of and priority to U.S. patent application Ser. No. 16/951,379 filed Nov. 18, 2020, which is a continuation of and claims the benefit of and priority to U.S. patent application Ser. No. 16/843,337, filed Apr. 8, 2020, which is a continuation of and claims the benefit of and priority to U.S. patent application Ser. No. 15/991,683 filed May 29, 2019, which is a continuation-in-part of and claims the benefit of and priority to U.S. patent application Ser. No. 15/850,130 filed Dec. 21, 2017, the entire contents of each of which are incorporated herein by reference as if fully set forth herein.

FIELD

The present invention generally relates to a toy projectile launcher capable of launching a substantially large number of projectiles without reloading.

BACKGROUND

Toy guns that discharge soft projectiles, such as toy foam darts—commonly referred to as "launchers" or "shooters"—are well known in the art. A typical magazine that holds darts that are discharged by such launchers is a clip or a cartridge that has an open top, a closed bottom, and a biasing spring that biases the darts upwardly, from the bottom of the magazine to the top.

Currently, darts are loaded into empty magazines one dart at a time. The time and effort it takes to reload a launcher that can launch a multitude of darts in this manner is one of the most frustrating aspects of playing with a launcher. Specifically, during the time period that one is reloading a launcher, one is vulnerable to being shot at by one's opponents in a dart war game. This situation could be alleviated by carrying a spare magazine, a belt with a plurality of spare magazines, a drum, or some other source of spare darts. However, there is a limit to the number of spare magazines that one could carry.

Furthermore, although it also follows that a launcher that could launch a lot of darts will yield more fun between reloads, the downside to being able to launch a lot of darts is that it will take longer amount of time to reload the launcher. Thus, a key determinant to ensuring a pleasurable and satisfying experience when using a toy projectile launcher remains the amount time it takes to reload the launcher. Accordingly, a system for reducing the time required to reload a toy projectile launcher is desirable.

SUMMARY

The present invention generally relates to toy projectile launchers, and in embodiments, to a projectile launcher that enables a user to load the launcher simply by grabbing a handful of projectiles and dropping them into a container that leads directly to the firing chamber of the launcher.

According to an exemplary embodiment of the present invention, a toy projectile launcher includes a housing defining an interior recess and a hopper coupled to the interior recess of the housing. The hopper is configured to house one or more projectiles and to provide the one or more projectiles to the interior recess of the housing so that they can be launched from the housing. The hopper includes a wall and an agitating member that is associated with the wall and is configured to cause the one or more projectiles to move within the hopper.

In embodiments, an opening may be provided in the agitating member.

In embodiments, the toy projectile launcher may include a wheel having a finger extending therefrom, and the wheel may protrude through the opening in the agitating member.

In embodiments, the agitating member may be agitated as a result of contact between the finger and an edge of the opening in the agitating member.

In embodiments, the agitating member may slope downwardly from the wall to the housing to guide the one or more projectiles into the housing.

In embodiments, the interior recess of the housing may include a firing chamber, and the agitating member may guide the one or more projectiles into the firing chamber.

In embodiments, the firing chamber may include a rotating track to advance the one or more projectiles from the firing chamber.

In embodiments, the one or more projectiles may be provided to the interior recess of the housing one at a time.

In embodiments, the agitating member may be coupled to the wall by a hinge.

In embodiments, the one or more projectiles may include toy foam darts.

According to an exemplary embodiment of the present invention, a toy projectile launcher includes a housing defining an interior recess and a hopper coupled to the interior recess of the housing. The hopper is configured to house one or more projectiles and to provide the one or more projectiles to the housing so that they can be launched from the housing. The hopper includes a first wall, an agitating member associated with the first wall and configured to cause the one or more projectiles to move within the hopper, a cover having an underside which faces into the hopper, and a ceiling that is collapsibly attached to the underside of the cover.

In embodiments, the ceiling may include a plurality of nested members attached to the underside of the cover.

In embodiments, the plurality of nested members may expand into the hopper when the cover is closed.

In embodiments, the ceiling may rest on top of the one or more projectiles that are housed in the hopper.

In embodiments, the ceiling may include a spring attached to the underside of the cover.

According to an exemplary embodiment of the present invention, a toy projectile launcher includes a housing defining an interior recess and a hopper coupled to the interior recess of the housing. The hopper is configured to house one or more projectiles and to provide the one or more projectiles to the housing so that they can be launched from the housing. The hopper includes a wall that is movable to facilitate loading of the one or more projectiles into the hopper.

In embodiments, the wall may be rotatable about the housing for a predetermined distance.

In embodiments, the wall may be movable to a degree that accommodates entry of a partially closed fist of a user into the hopper.

In embodiments, the wall may be a rear wall of the hopper.

In embodiments, the toy projectile launcher may include a cover for the hopper that is rotatably coupled to the rear wall.

According to an exemplary embodiment of the present invention, a toy projectile launcher includes a housing defining an interior recess, a firing chamber disposed within the interior recess and configured to receive a projectile, a rotating track disposed at a bottom of the firing chamber to advance the projectile out of the firing chamber, and a push rod configured to enter the firing chamber. The push rod cooperates with the rotating track to advance the projectile from the firing chamber.

In embodiments, the push rod may push the projectile as the projectile is being advanced from the firing chamber by the rotating track.

In embodiments, a tip of the push rod may extend halfway into the firing chamber.

In embodiments, the push rod may be a reciprocating push rod.

In embodiments, the firing chamber may be configured to receive one projectile at a time.

According to an exemplary embodiment of the present invention, a toy projectile launcher includes a housing defining an interior recess, and a hopper coupled to the interior recess of the housing. The hopper is configured to house one or more projectiles, such as toy foam darts, and to provide the one or more projectiles to the housing to be launched from the housing. The hopper includes a first wall and a front wall, an agitating member coupled to the first wall and configured to cause the one or more projectiles to move within the hopper, a cover having an underside which faces into the hopper, a plurality of openings in the first wall or the front wall, wherein the openings are spaced apart from one another and extend in substantial alignment from an upper position to a lower position on one of the first or front walls, a ceiling having a ceiling plate that is collapsibly attached to the underside of the cover and is expandable downward from the cover into the hopper when the cover is closed, and a catch that is coupled to the ceiling plate and configured to engage with at least a first opening of the plurality of openings when the hopper is loaded with a first amount of the one or more projectiles to prevent the cover from collapsing back into the underside of the cover when the cover is closed onto the hopper.

In embodiments, the catch is further configured to disengage from the first opening and engage with a second opening of the plurality of openings located at a second position lower in the hopper than the first position when the hopper is loaded with a second amount of the one or more projectiles following a launch of one or more of the one or more projectiles from the hopper, wherein the second amount of the one or more projectiles is less than the first amount is loaded in the hopper.

In embodiments, the catch is coupled to the ceiling plate with a spring to allow engagement and disengagement of the catch from one or more of the plurality of openings.

In embodiments, the catch is configured to disengage from any of the plurality of openings in which the catch is engaged upon an opening of the cover of the hopper.

In embodiments, the ceiling plate is configured to rest on top of the one or more projectiles housed in the hopper.

In embodiments, the ceiling further includes a plurality of nested members, between an interior side of the ceiling plate and the underside of the cover, wherein the plurality of nested members are extendible downward from the cover.

In embodiments, the ceiling plate includes a spring attached to the underside of the cover.

In embodiments, the plurality of openings are substantially vertically aligned.

In embodiments, the hopper includes a third wall that is movable to facilitate loading of the one or more projectiles into the hopper. The third wall may be rotatable about the housing for a predetermined distance and may be movable to a degree that accommodates entry of a partially closed fist of a user into the hopper.

In embodiments, the third wall includes a rear wall of the hopper. In embodiments, the cover for the hopper is rotatably coupled to the rear wall.

In embodiments, the toy projectile launcher further includes a third wall opposite the first wall, and a second agitating member coupled to the third wall and configured to cause the one or more projectiles to move within the hopper.

According to an exemplary embodiment of the present invention, a toy projectile launcher includes a housing defining an interior recess, and a hopper coupled to the interior recess of the housing, the hopper configured to house one or more projectiles, such as toy foam darts, and to provide the one or more projectiles to the interior recess of the housing to be launched. The hopper includes a first wall on a first side of the hopper, a second wall on a second side of the hopper opposite the first wall, and at least two agitating members, including a first agitating member associated with the first wall, and a second agitating member associated with the second wall. The first and second agitating members are configured to cause the one or more projectiles to align within the hopper.

In embodiments, the first and second agitating members are agitated by different agitating mechanisms.

In embodiments, the first and second agitating members are configured to be agitated substantially simultaneously.

In embodiments, the first and second agitating members are configured to be agitated one at a time.

In embodiments, the first and second agitating members are configured to be sequentially activated with agitation in the hopper alternating between agitation by the first agitating member and agitation by the second agitating member.

In embodiments, the toy projectile launcher further includes a first wheel having a finger extending therefrom and configured to agitate the first agitating member by intermittent contact between the finger and the first agitating member.

In embodiments, the toy projectile launcher further includes a second wheel coupled to a arm that is configured to agitate the second agitating member by intermittent contact between the arm and the second agitating member. In embodiments, the second wheel is configured to rotate in a single direction. In embodiments, the second wheel is configured to alternate between rotation in a clockwise direction and in a counterclockwise direction.

In embodiments, the first agitating member slopes downwardly to the housing to guide the one or more projectiles into the interior recess of the housing.

In embodiments, the second agitating member slopes downwardly to the housing to guide the one or more projectiles into the interior recess of the housing.

In embodiments, the interior recess of the housing includes a firing chamber, and the first and second agitating members are configured to guide the one or more projectiles into the firing chamber. In embodiments, the firing chamber includes a rotating track to advance the one or more projectiles from the firing chamber.

In embodiments, the one or more projectiles are to be provided to the interior recess of the housing one at a time.

In embodiments, the first agitating member is coupled to the first wall by a first hinge and the second agitating member is coupled to the second wall by a second hinge.

According to an exemplary embodiment of the present invention, a toy projectile launcher includes a housing having an opening and a hopper detachably coupled to the opening of the housing. The hopper is configured to house one or more projectiles, such as toy foam darts, and to provide the one or more projectiles to the housing to be launched from the housing. The hopper includes a first wall, a second wall disposed opposite the first wall, a cover having an underside which faces into the hopper, a first plurality of openings in the first wall, wherein the first plurality of openings are spaced apart from one another and extend in substantial alignment from an upper position to a lower position on the first wall, a second plurality of openings in the second wall, wherein the second plurality of openings are spaced apart from one another and extend in substantial alignment from an upper position to a lower position on the second wall, a ceiling plate that is collapsibly attached to the underside of the cover and is expandable downward from the cover into the hopper when the cover is closed, a first catch coupled to the ceiling plate and configured to engage with at least a first opening of the first plurality of openings when the hopper is loaded with a first amount of the one or more projectiles to prevent the cover from collapsing back into the underside of the cover when the cover is closed onto the hopper, and a second catch coupled to the ceiling plate and configured to engage with at least a first opening of the second plurality of openings when the hopper is loaded with the first amount of the one or more projectiles to prevent the cover from collapsing back into the underside of the cover when the cover is closed onto the hopper.

In embodiments, the first catch is further configured to disengage from the first opening of the first plurality of openings and engage with a second opening of the first plurality of openings located at a second position lower in the hopper than the first position when the hopper is loaded with a second amount of the one or more projectiles following a launch of one or more of the one or more projectiles from the hopper and the second catch is further configured to disengage from the first opening of the second plurality of openings and engage with a second opening of the second plurality of openings located at a second position lower in the hopper than the first position when the hopper is loaded with the second amount of the one or more projectiles following a launch of one or more of the one or more projectiles from the hopper, wherein the second amount of the one or more projectiles is less than the first amount is loaded in the hopper.

In embodiments, at least one of the first catch and the second catch is coupled to the ceiling plate with a spring to allow engagement and disengagement of the at least one of the first catch and the second catch from one or more of the first plurality of openings and/or the second plurality of openings.

In embodiments, at least one of the first catch or the second catch is configured to disengage from any of the first plurality of openings and/or the second plurality of openings in which the at least one of the first catch or the second catch is engaged upon an opening of the cover of the hopper.

In embodiments, the ceiling plate is configured to rest on top of the one or more projectiles housed in the hopper.

In embodiments, the ceiling plate comprises a spring attached to the underside of the cover.

In embodiments, at least one of the first plurality of openings and the second plurality of openings are substantially vertically aligned.

In embodiments, at least one of the openings in the first plurality of openings has a sloping orientation.

In embodiments, at least one of the openings in the first plurality of openings near the bottom of the hopper has a sloping orientation.

In embodiments, at least one of the openings in the second plurality of openings has a sloping orientation.

In embodiments, at least one of the openings in the second plurality of openings near the bottom of the hopper has a sloping orientation.

In embodiments, the cover for the hopper is rotatably coupled to the hopper.

In embodiments, the ceiling further includes a plurality of nested members, between an interior side of the ceiling plate and the underside of the cover, wherein the plurality of nested members are extendible downward from the cover.

In embodiments, the hopper further includes an agitating member that is disposed between the first wall and the second wall and is configured to facilitate the orderly descent of the one or more projectiles within the hopper.

According to an exemplary embodiment of the present invention, a toy projectile launcher includes a housing defining an interior recess and a hopper detachably coupled to the interior recess of the housing. The hopper configured to house one or more projectiles, such as toy foam darts, and to provide the one or more projectiles to the interior recess of the housing to be launched from the housing. The hopper includes a first wall on a first side of the hopper, a second wall on a second side of the hopper opposite the first wall, a rotating belt to deliver the one or more projectiles to the interior recess of the housing, and an agitating member disposed between the first wall and the second wall and rotatably coupled to the hopper, wherein rotation of the rotating belt imparts a flapping motion to the agitating member. to facilitate the orderly descent of the one or more projectiles within the hopper.

In embodiments, the agitating member straddles the rotating belt.

In embodiments, the flapping of the agitating member agitates the one or more projectiles within the hopper to facilitate an orderly descent of the one or more projectiles within the hopper.

In embodiments, a gear is coupled to the rotating belt and the gear includes a structure that extends outwardly from an end of the gear.

In embodiments, the structure that extends outwardly from the end of the gear intermittently contacts the agitating member to impart the flapping motion to the agitating member.

In embodiments, the interior recess of the housing includes a firing chamber and the rotating belt delivers the one or more projectiles into the firing chamber.

In embodiments, the firing chamber includes a rotating gear to advance the one or more projectiles from the firing chamber.

In embodiments, the one or more projectiles are to be provided to the interior recess of the housing one at a time.

In embodiments, the agitating member is rotatably coupled to the hopper by a hinge.

BRIEF DESCRIPTION OF THE DRAWINGS

Various exemplary embodiments of this invention will be described in detail, with reference to the following figures, wherein.

DETAILED DESCRIPTION

Figure 1:
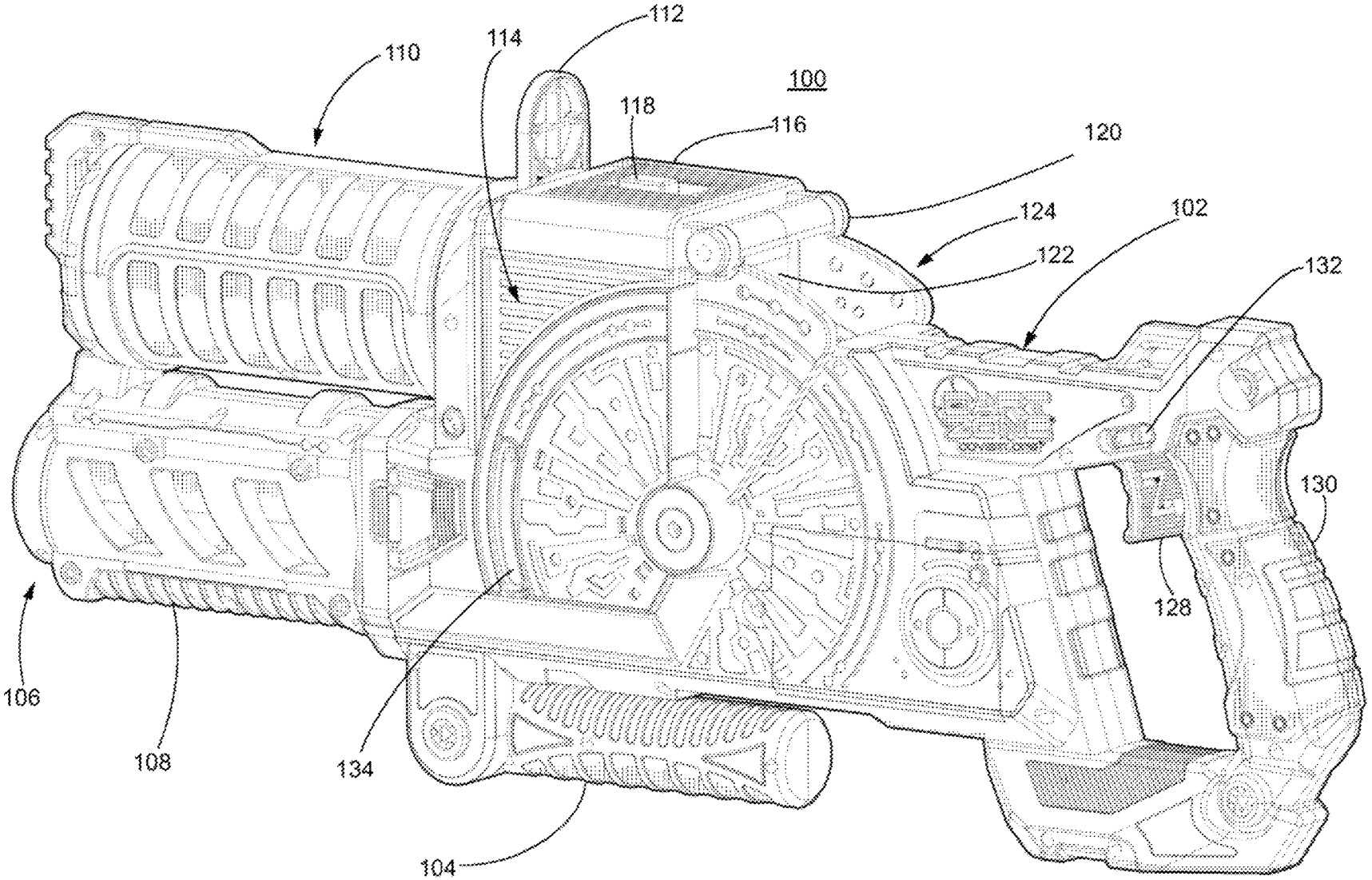
FIG. 1 shows a left side perspective view of a toy projectile launcher in accordance with exemplary embodiments of the present invention.
Figure 2:
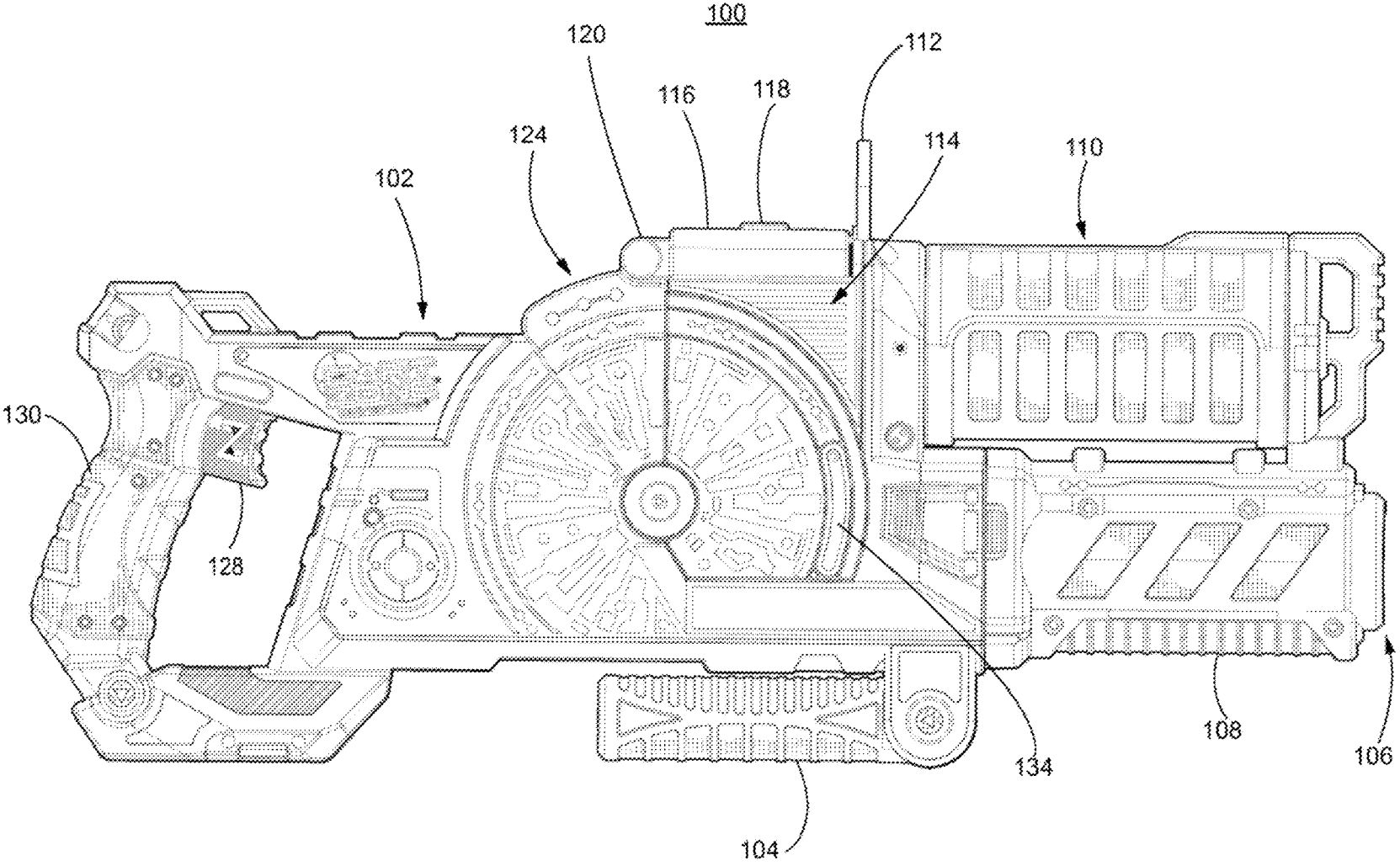
FIG. 2 shows a right side view of the toy projectile launcher shown in FIG. 1.
Figure 3:
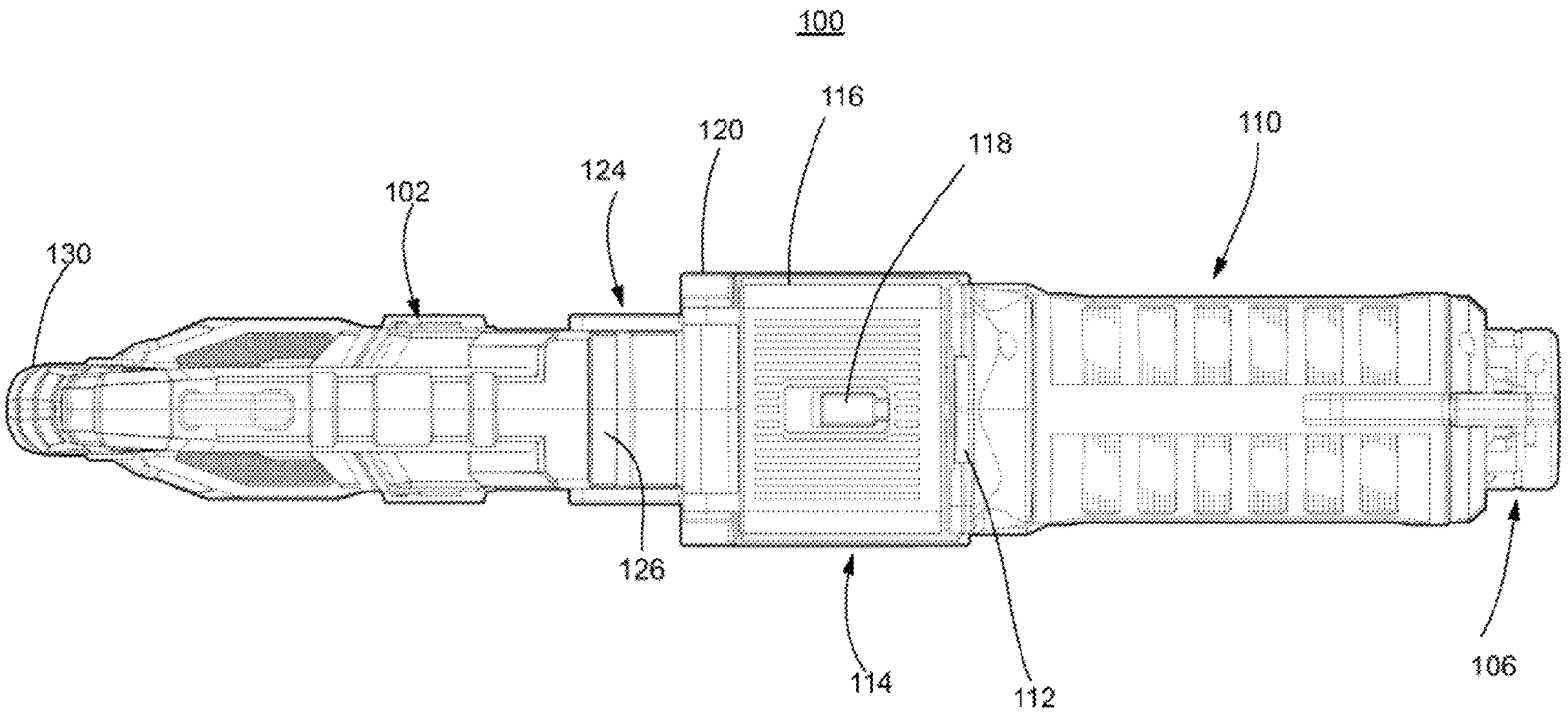
FIG. 3 shows a top view of the toy projectile launcher shown in FIG. 1.
Figure 4:
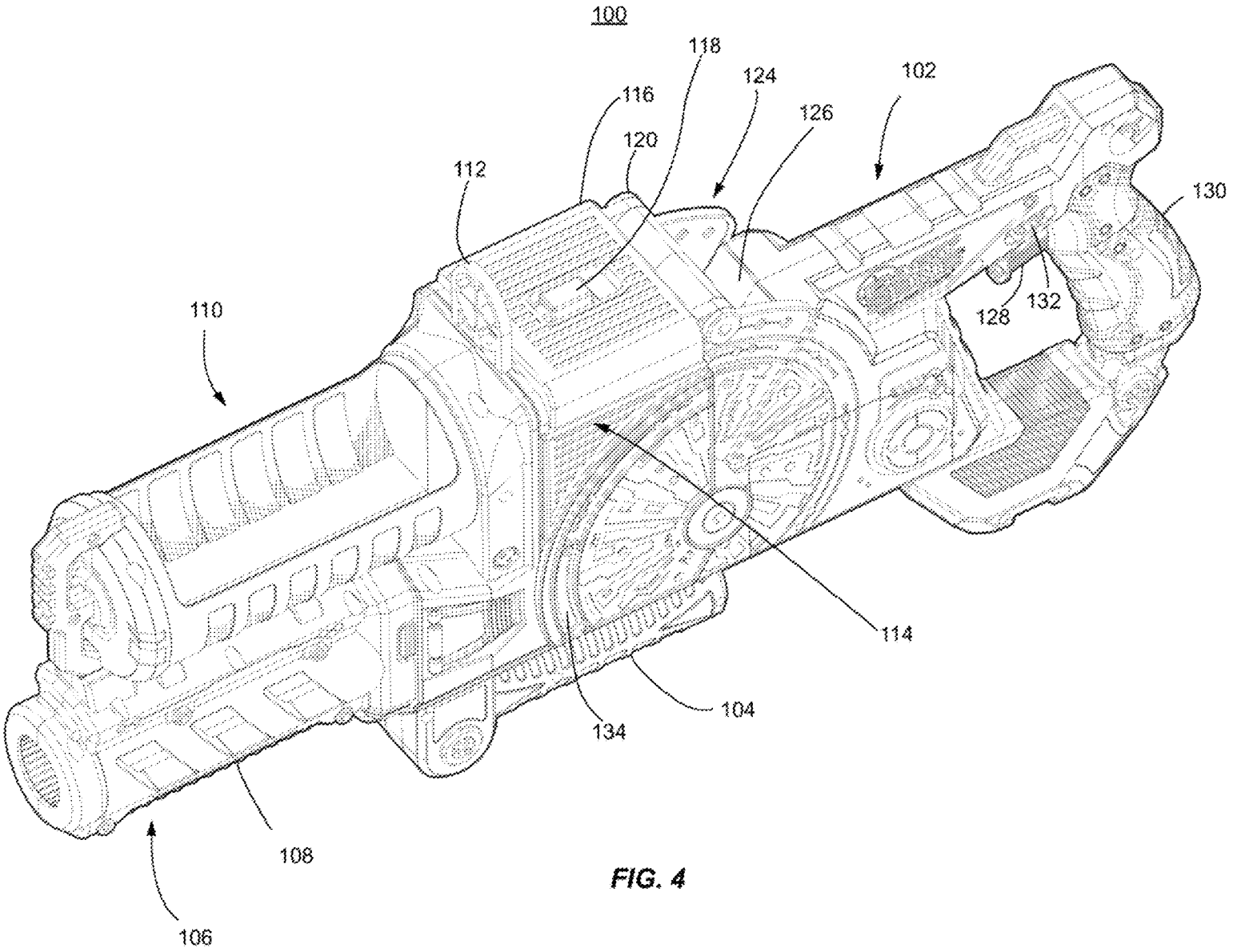
FIG. 4 shows atop, left side perspective view of the toy projectile launcher shown in FIG. 1.

The present invention is directed towards a projectile launcher—for example, a toy foam dart launcher—that is capable of launching a substantially large number of projectiles in rapid succession, thereby reducing the number of times needed to reload the projectile launcher. To increase the number of projectiles that can be launched between reloadings, the projectiles are housed in a hopper. The hopper may include a movable rear wall which facilitates the loading of a large number of projectiles into the hopper at one time. In addition, a portion of a side wall of the hopper may be agitated to loosen the projectiles within the hopper so that they will drop into a firing chamber of the toy projectile launcher more easily. Furthermore, a cover for the hopper may have a collapsible ceiling to prevent the projectiles from becoming improperly oriented in the hopper as they are being loosened by the agitated portion of the side wall of the hopper. These features, standing alone or in combination, enable a user to load the toy launcher with a substantially large number of projectiles, thus reducing the number of times the user must reload the toy launcher.

The use of hoppers and vibrating chutes is known in large-scale industrial manufacturing processes. For example, U.S. Pat. No. 2,753,977 ("the '977 Patent"), entitled "Feeding Apparatus for Nail Weighing Machines," discloses a feed mechanism for a nail weighing machine. The feed mechanism includes a supply hopper which has an open top for receiving nails, an opening at its lower end through which nails are provided to a conveyor of the nail weighing machine, and side walls which incline downwardly toward one another in the direction of the lower-end opening. As described in the '977 Patent, when nails are dumped into the supply hopper, the inclined nature of the side walls tends to cause the nails to jam between the side walls. To prevent the jamming of the nails between the side walls, the supply hopper 50 includes a vibrating panel or side wall located in the hopper.

However, such large-scale industrial hoppers do not teach the use of a hopper structure in the environment of a toy foam dart shooter. For instance, the hopper disclosed in the '977 Patent provides nails to a vibrating conveyor. As such, the nails are not delivered to the nail weighing machine rapidly, and they are delivered without regard to the direction in which the nails are pointing. In contrast, in a toy foam dart shooter in accordance with embodiments of the present invention, it is critical to be able to deliver the darts into the firing chamber of the dart launcher as rapidly as possible and with their tips pointed toward the barrel of the launcher. Furthermore, in a typical magazine for a toy foam dart launcher (e.g., a clip or a cartridge), the darts are biased upwardly, from the bottom of the magazine to its top, for loading into the firing chamber of the launcher. Thus, toy dart launchers have heretofore not had a need to vibrate or shake a dart (or any other type of projectile or accessory) downwards, and providing such a capability would only increase the cost of the launcher (by requiring a battery-operated motor) without providing any benefit.

It was not until the present invention that the applicability and advantages of the novel use of a hopper structure, and related features, have been recognized and appreciated in the context of a toy foam dart shooter. As described in detail below, a toy foam dart launcher in accordance with embodiments of the present invention advantageously employs a hopper structure to enable a user to load a toy dart launcher with a substantially large number of projectiles more quickly and more easily.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Referring to FIGS. 1-6, a toy projectile launcher 100 may be configured to launch one or more projectiles (not shown) therefrom. In embodiments, the projectiles may be non-lethal projectiles for use in recreational activities, and may be, for example, darts, arrows, balls, and/or discs, to name a few, in any combination or separation. The projectiles may include one or more performance-enhancing and/or decorative features, for example, suction cups, fins, whistles and/or other sound generating devices, one or more fluid-retaining portions, dyes or other transferable colorants, and/or collapsible portions, to name a few.

The projectiles may be formed of a lightweight and/or force-dampening material such as foam, rubber, or the like, so that the projectiles are suitable for use in play and/or sport activities involving, for example, children. In this manner, the projectiles are configured to impact a target, such as a portion of a human body, an animal, or an inanimate object without causing discomfort, pain, and/or damage thereto. In exemplary embodiments, the projectiles may be toy foam darts of the type described in U.S. Pat. No. 9,285,194 entitled "Foam Dart Having a Safety Cap," the entire contents of which are incorporated by reference herein. For convenience, the following description of projectile launcher 100 assumes that the projectiles are toy foam darts.

Figure 7A:
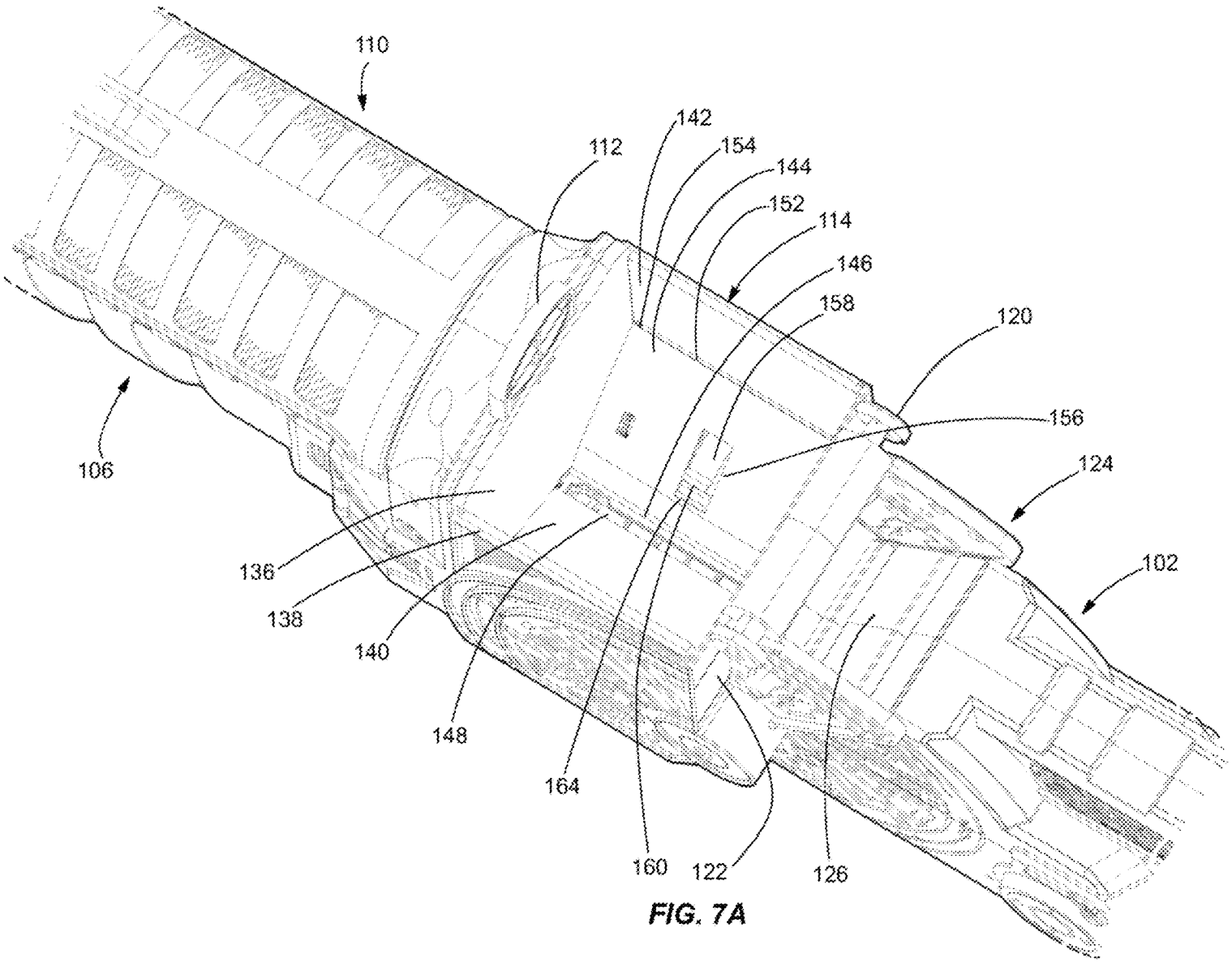
FIGS. 7A, 7B, and 7C illustratively depict various elements of the toy projectile launcher in accordance with exemplary embodiments of the present invention.
Figures 7B, 7C:
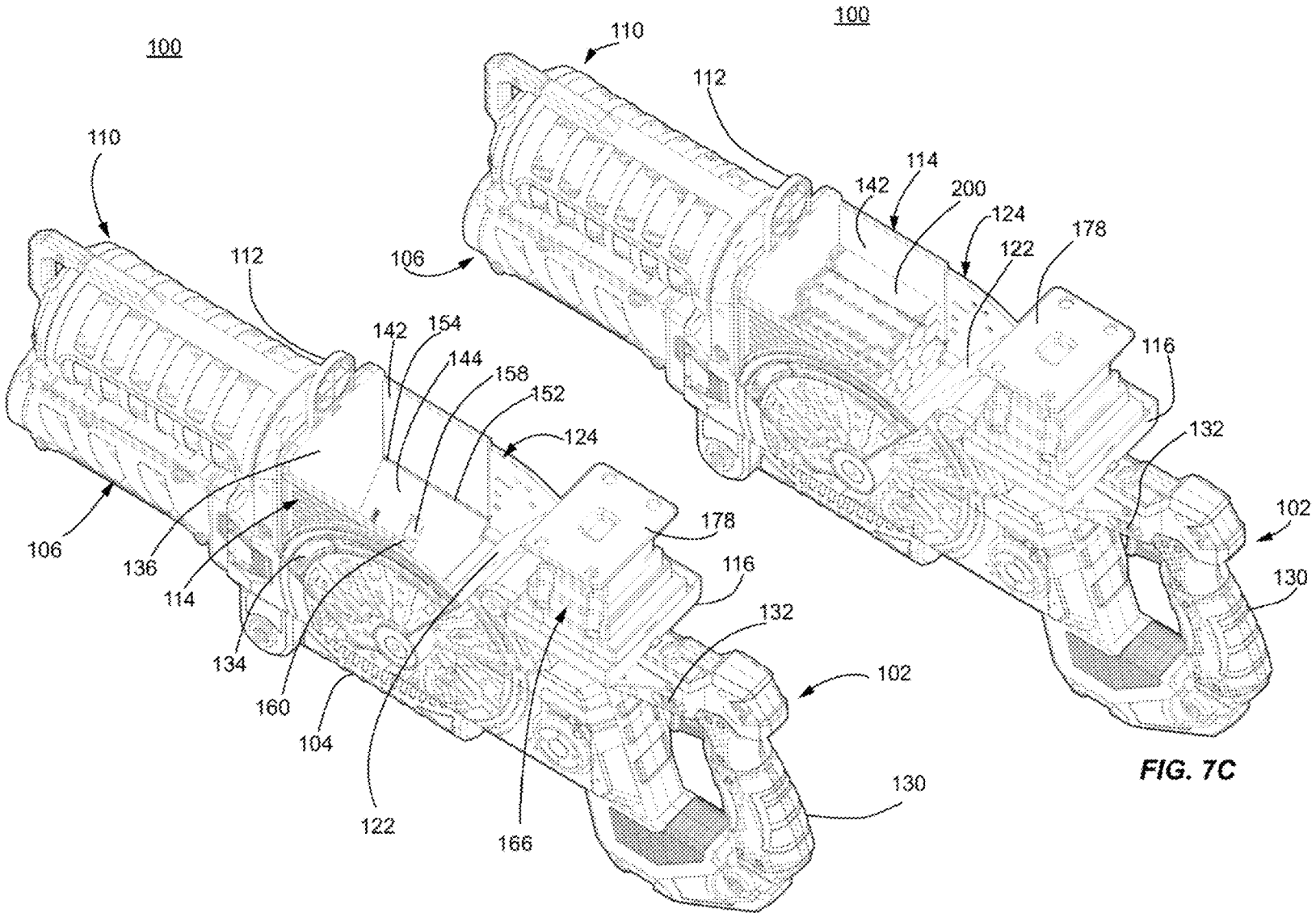
Figure 8:
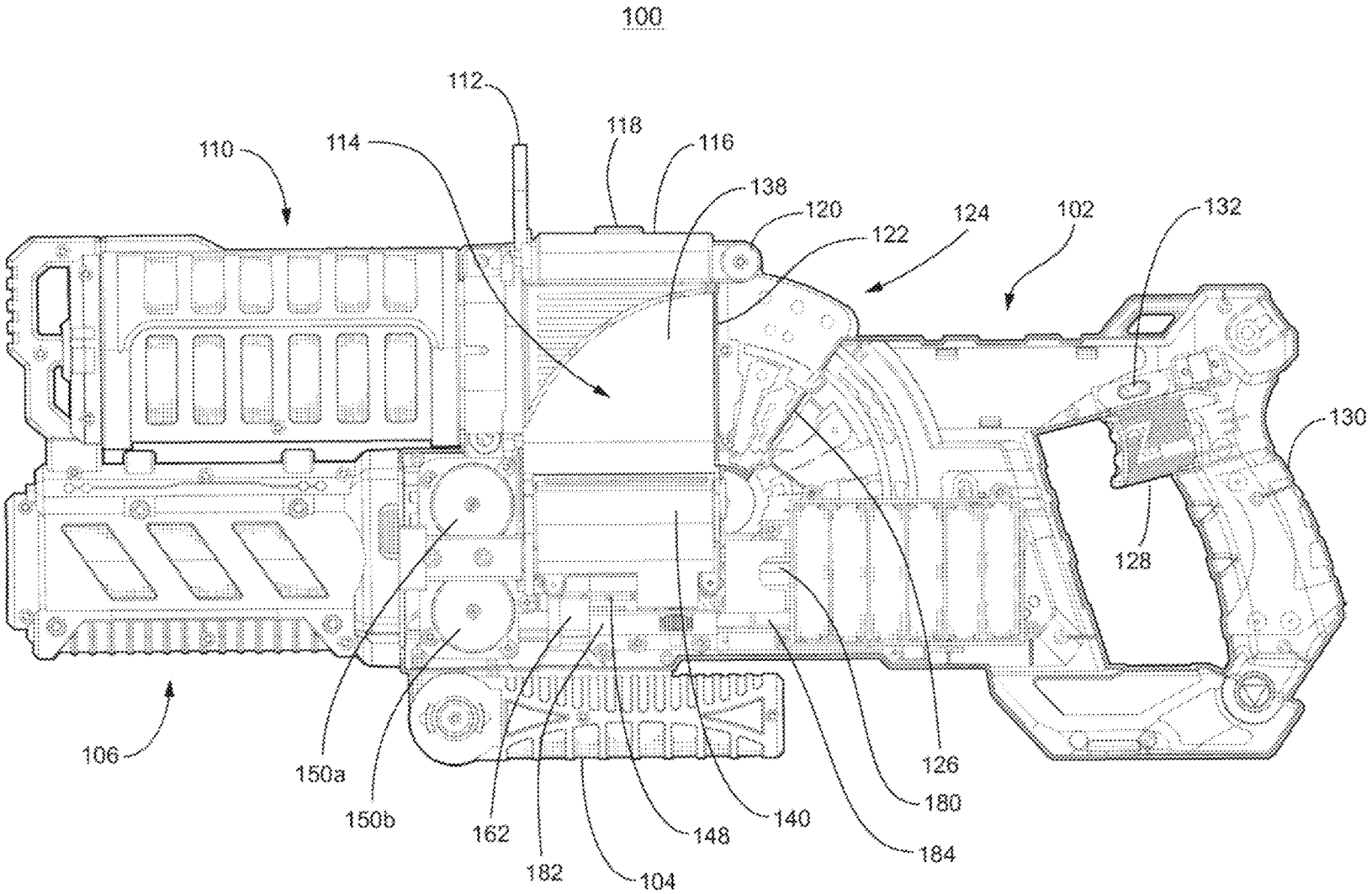
FIG. 8 illustratively depicts various elements of the toy projectile launcher in accordance with exemplary embodiments of the present invention.
Figure 9:
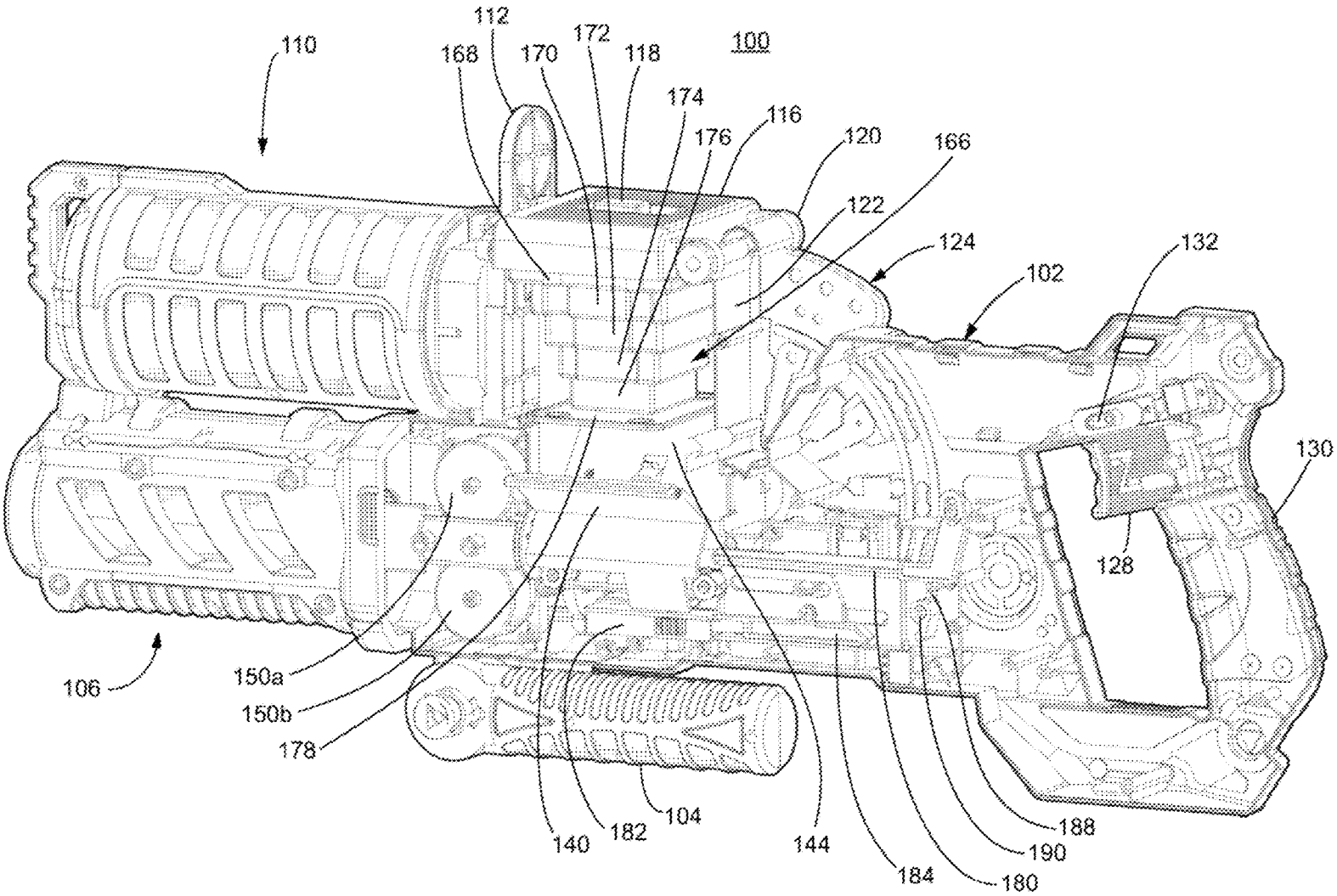
FIG. 9 illustratively depicts various elements arranged in an interior recess of the housing of the toy projectile launcher in accordance with exemplary embodiments of the present invention.

Projectile launcher 100 includes a housing 102. In embodiments, housing 102 may include various external handling or mounting structures, such as a retractable forward grip 104, a detachable barrel 106, a storage compartment 110 for storing extra projectiles, and a sighting member 112. Retractable forward grip 104 may be rotatable such that it may be positioned rearward as in FIG. 1, forward as in FIG. 12A, or at a position therebetween. Barrel 106 may include an underside grip 108. As shown in FIGS. 7A and 8, housing 102 has a hollow interior recess to accommodate the internal components of launcher 100.

Figure 5:
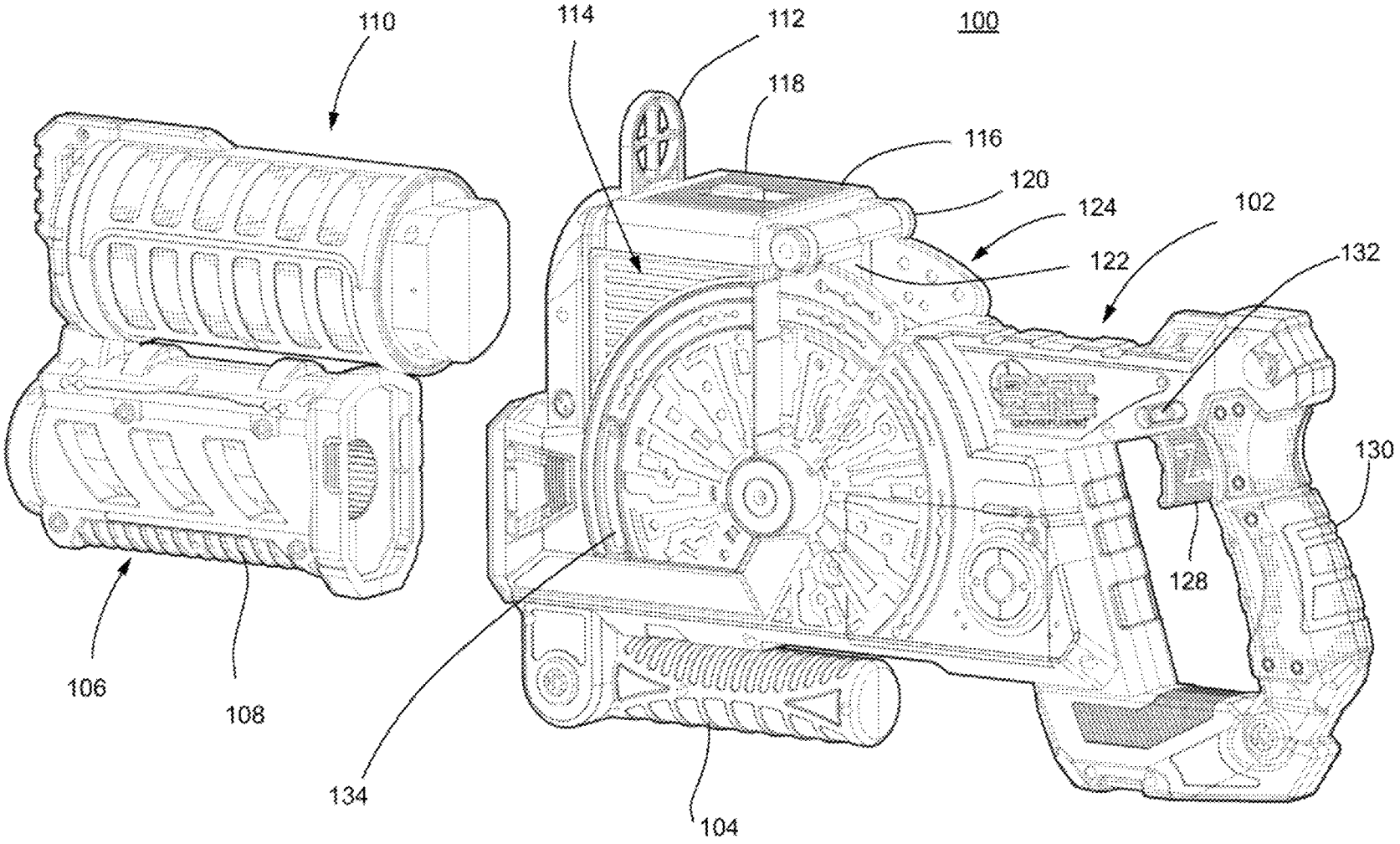
FIG. 5 shows an exploded view of the toy projectile launcher shown in FIG. 1.
Figure 6:
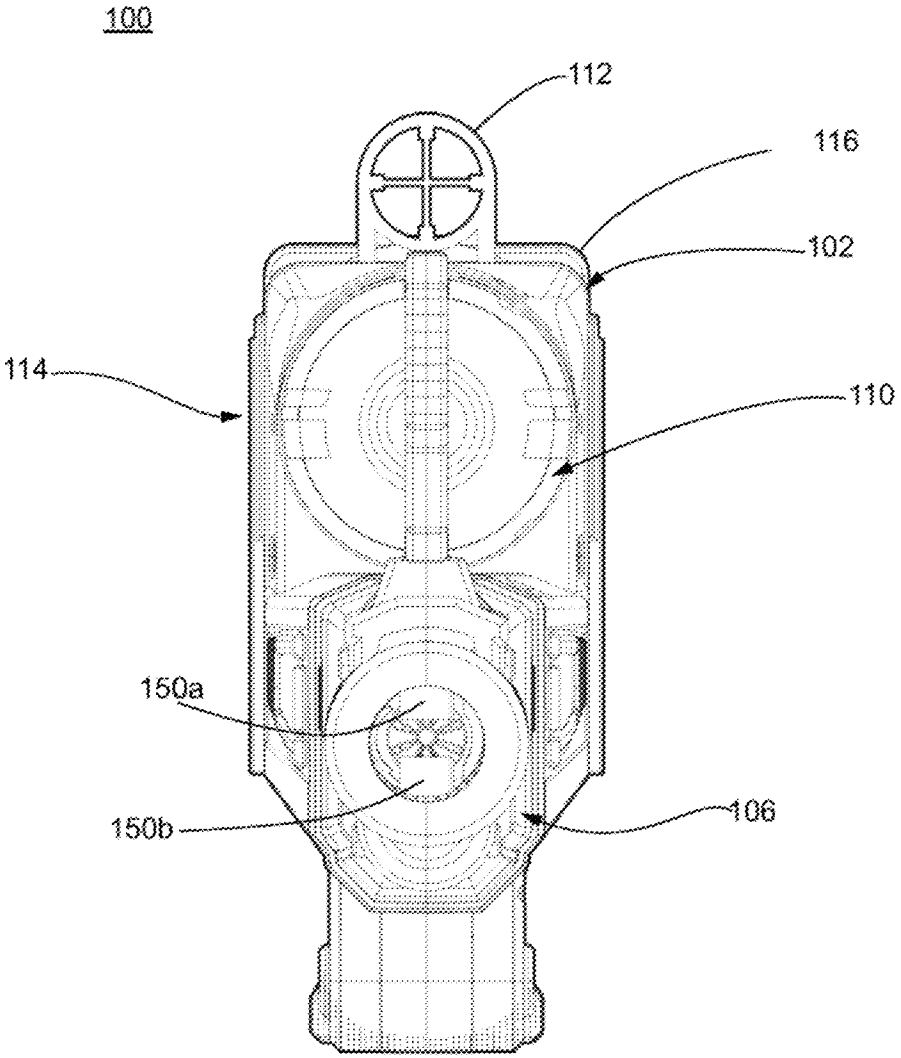
FIG. 6 shows a front view of the toy projectile launcher shown in FIG. 1.

As shown in FIG. 5, barrel 106 and storage compartment 110, and various other external structures, may be attached and/or connected and/or interfit and/or otherwise detachably coupled with housing 102. In alternative embodiments, barrel 106, underside grip 108, storage compartment 110, and various other external structures may be monolithically formed with the housing 102 of projectile launcher 100. In embodiments, the housing 102 may also be configured to receive various accessories for projectile launcher 100, for example, a scope, and/or a source of illumination, to name just a few additional accessories.

Referring now to FIGS. 5 and 7A, in exemplary embodiments, projectile launcher 100 includes a hopper 114 to house darts that will be launched from projectile launcher 100 through barrel 106. Hopper 114 is enclosed by a cover 116, a front wall 136, side walls 138 and 142, and a portion 122 (i.e., a rear wall) of a movable rear wall assembly 124. As described in detail below, movable rear wall assembly 124 facilitates the loading of darts into the hopper 114. Cover 116 sits atop hopper 114, and is rotatably coupled to rear wall assembly 124 by hinge 120. Cover 116 is locked in place by pushing switch 118 forward (i.e., toward sighting member 112). In embodiments, this causes a latch 117 on the top front of cover 116 to engage a slot 119 on the front wall of the hopper 114 to hold the hopper cover 116 closed.

To load darts into hopper 114, the user first unlocks cover 116 by moving switch 118 backwards (i.e., toward hinge 120). The user then rotates cover 116 backwards around hinge 120, and opens rear wall assembly 124 by moving it backwards (i.e., towards rear grip 130). Rear wall assembly 124 rotates about housing 102 for a distance determined by its arcuate slots 134, until portion 122 of rear wall assembly 124 rests against portion 126 of housing 102.

With hopper 114 now open, the user can grab a handful of toy foam darts in his or her fist. In exemplary embodiments, the user can grab a maximum of about five foam darts at a time and, with the front of launcher 100 pointed downwards at a slight angle, place the darts in hopper 114 with the tips of the darts pointing toward the front of launcher 100 (i.e., toward barrel 106). (Since the tip of a dart is heavier than its foam body, the dart tips will be placed into hopper 114 first. Pointing the front of launcher 100 downwards at a slight angle thus allows the front wall 136 of hopper 114 to align the toy foam darts appropriately.) In exemplary embodiments, a maximum of forty darts can be loaded into the hopper 114 in this manner. Once a desired quantity of darts is loaded into hopper 114, the user pushes rear wall assembly 124 forward until portion 122 of rear wall assembly 124 sits flush against hopper 114, flips cover 116 around hinge 120 and back into place atop hopper 114, and locks cover 116 and rear wall assembly 124 into place by moving switch 118 forwards (i.e., toward sighting member 112).

As shown in FIGS. 5 and 7A-7C, the use of movable rear wall assembly 124 greatly facilitates rapid loading of the darts 200 into hopper 114. Specifically, when a user grabs a handful of darts 200, his or her fist is in a generally closed position. When the user inserts his or her closed fist into hopper 114 to deposit the darts 200 therein, with the tips of the darts pointing forward (i.e., toward barrel 106), the width of hopper 114 must be sufficiently large to ensure sufficient clearance. This poses a problem, however, because a wide container means a deep display package for launcher 100, which is uneconomical because it increases the costs associated with shipping commercial quantities of launcher 100. By providing a rear wall assembly 124 for hopper 114 which is capable of opening and closing as described above, it becomes possible for the partially closed fist of a user to enter hopper 114 to deposit darts 200.

Referring now to FIGS. 7A-7C, 8, and 9, hopper 114 includes front wall 136 and side walls 138, 142. A first projectile guide member 140 slopes downwardly from the bottom of side wall 138 toward firing chamber 146. Similarly, a second projectile guide member 144 slopes downwardly from the bottom of side wall 142 toward firing chamber 146. In embodiments, the slope angle of first projectile guide member 140 with respect to side wall 138 may be approximately equal to the slope angle of second projectile guide member 144 with respect to side wall 142.

First and second projectile guide members 140, 144, along with rotating rubber track 148, cooperate to define a firing chamber 146 at the bottom of hopper 114. In exemplary embodiments, the dimensions of firing chamber 146 are such that it accepts a single projectile at a time.

In operation, and as described above, a user loads toy foam darts into hopper 114 by opening and closing cover 116 and rear wall assembly 124. Due to gravity, and guided by first and second projectile guide members 140, 144, the darts housed in hopper 114 drop down into firing chamber 146 one at a time as successive darts are launched from launcher 100.

Figure 10:
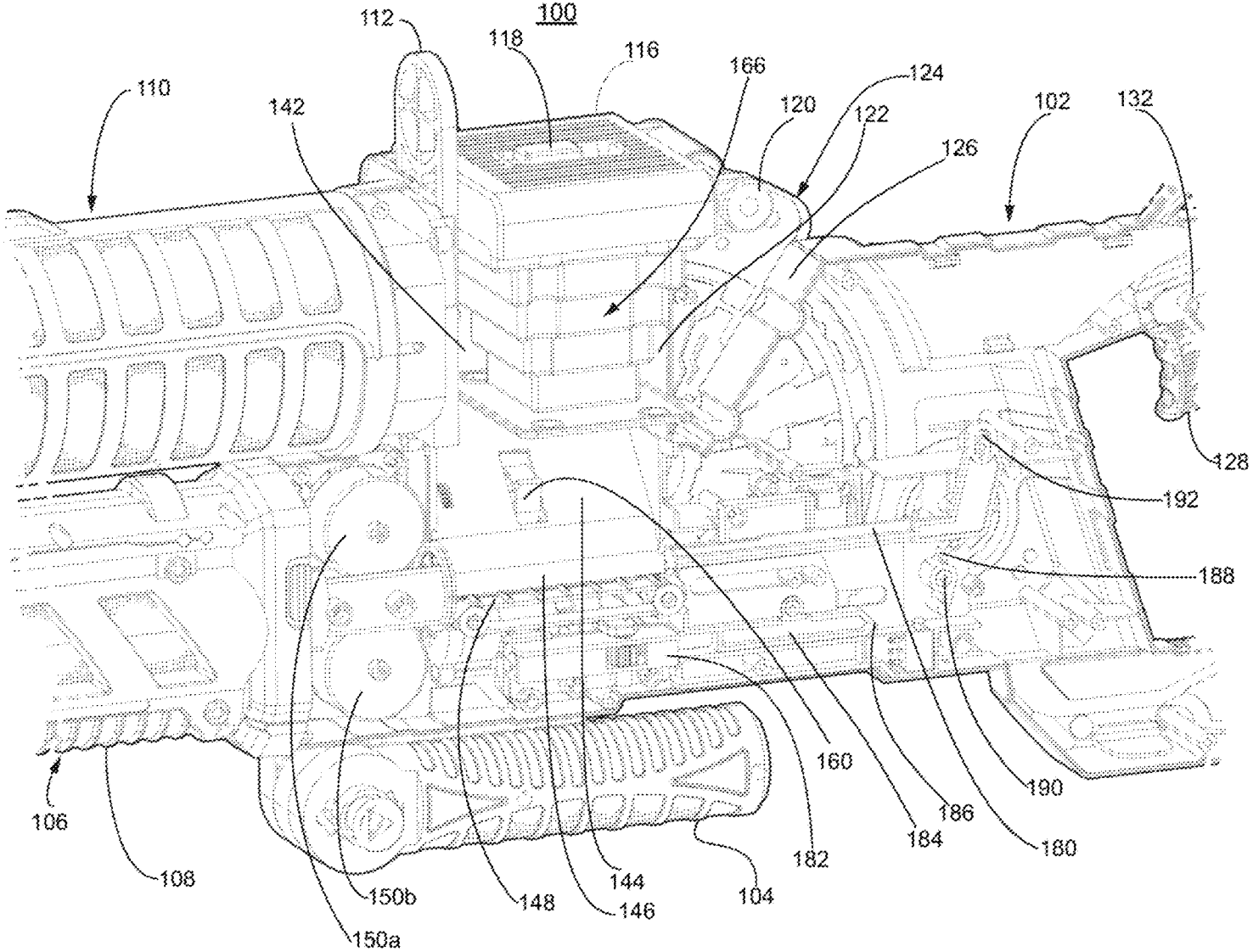
FIG. 10 illustratively depicts various elements of the toy projectile launcher in accordance with exemplary embodiments of the present invention.

In exemplary embodiments, when a toy foam dart is located in firing chamber 146, and the user pulls trigger 128, the dart is automatically delivered to a pair of spinning flywheels 150*a*, 150*b* using rotating rubber track 148 assisted by a reciprocating push rod 180. Referring to FIG. 10, as rubber track 148 rotates to advance a dart (not shown) from firing chamber 146 toward flywheels 150*a*, 150*b* (driven by one or more motors, not shown), cam 182 pushes follower 184 back until tapered edge 186 contacts arm 188. This contact causes arm 188 to rotate counterclockwise about pivot 190. Arm 188 is mechanically coupled to push rod 180 at opening 192 such that the counterclockwise rotation of arm 188 about pivot 190 moves push rod 180 forward, thereby pushing the dart in firing chamber 146 from the rear as it is being advanced toward flywheels 150*a*, 150*b* by rotating rubber track 148. In exemplary embodiments, the tip of push rod 180 may reach halfway along the length of firing chamber 146 when fully extended. The reciprocating action of push rod 180 is completed when cam 182 pulls follower 184 back, allowing arm 188 to rotate clockwise about pivot 190 and, consequently, returning push rod 180 to its initial position.

Using rotating rubber track 148 in combination with reciprocating push rod 180 to deliver a dart from firing chamber 146 to flywheels 150*a*, 150*b* advantageously increases the speed with which the darts are delivered and overcomes the pressure applied to the dart in firing chamber 146 from those darts located above it in hopper 114. In this way, launcher 100 can shoots darts as fast as they can drop into firing chamber 146 from hopper 114.

When energized, upper flywheel 150*a* rotates clockwise and lower flywheel 150*b* rotates counterclockwise. In exemplary embodiments, both flywheels 150*a*, 150*b* may be energized when the user switches on/off switch 132 of launcher 100 into the "on" position. In embodiments, both flywheels 150*a*, 150*b* may be energized when the user pulls the trigger 128 of launcher 100. In embodiments, both flywheels 150*a*, 150*b* rotate at the same rotational velocity.

The physical construction of the darts can affect the ease with which the darts drop down from hopper 114 into single firing chamber 146. Specifically, the foam surfaces of the darts, in addition to the soft rubber or plastic tips of the darts, can cause friction among the darts that are housed in hopper 114. As a result, the darts may tend to jam together inside hopper 114, and thus they may not fall freely into single firing chamber 146. This tendency may be exacerbated when, as shown in FIG. 7A, first projectile guide member 140 and second projectile guide member 144 slope downwardly together to guide the darts toward firing chamber 146.

It can be frustrating to a user of a toy foam dart launcher to line up a perfect shot only to "fire a blank" due to a jam occurring in hopper 114.

Figure 11:
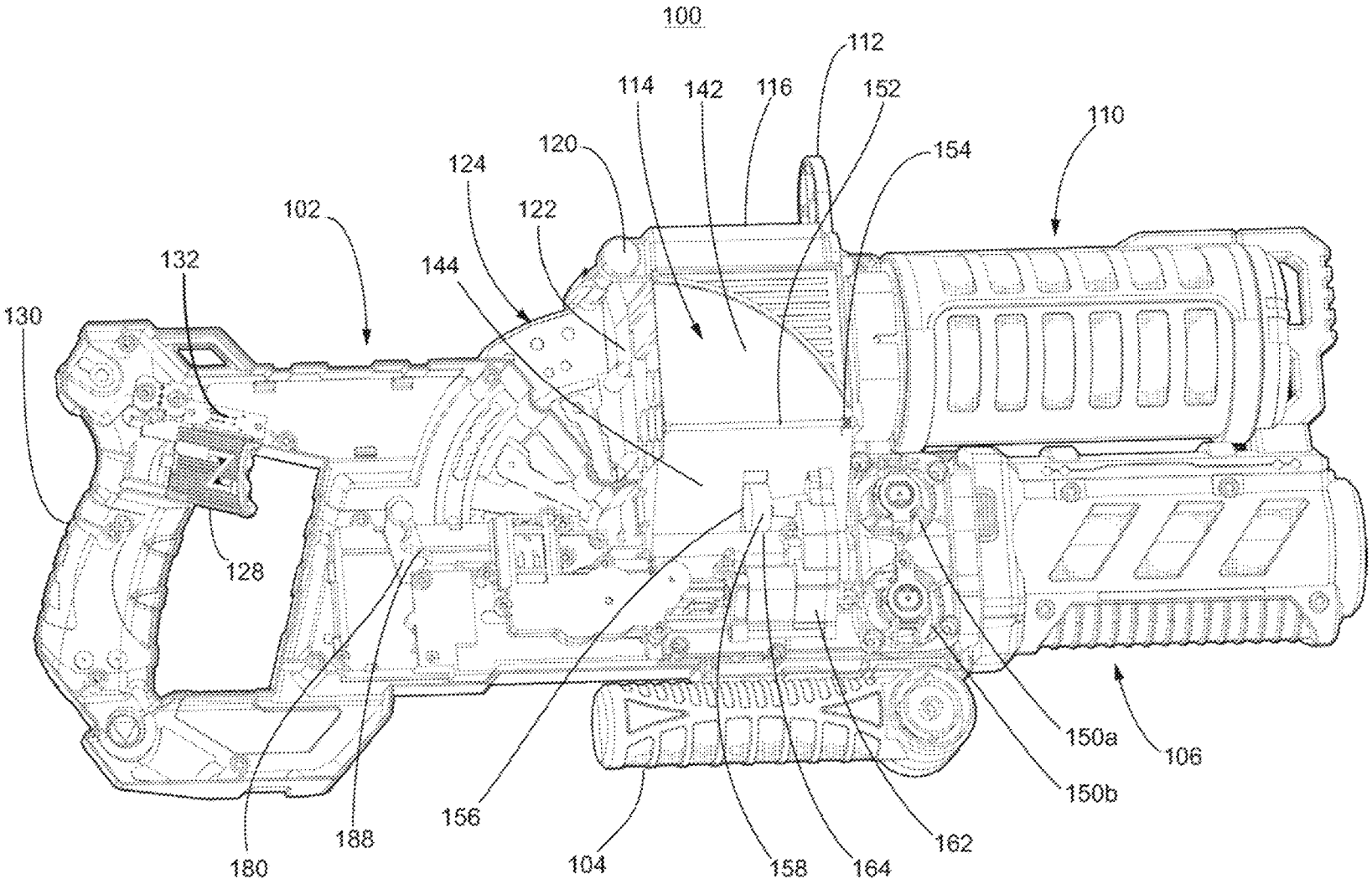
FIG. 11 illustratively depicts various elements of the toy projectile launcher in accordance with exemplary embodiments of the present invention.

One solution to the aforementioned problem is to agitate a portion of hopper 114. In exemplary embodiments, one portion of hopper 114 is agitated (e.g., moved up and down) to thereby loosen the darts in the hopper 114 so that they can fall freely into the single firing chamber 146. As shown in FIG. 11, in exemplary embodiments, second projectile guide member 144 is movably coupled to side wall 142, e.g., by a hinge 152. A torsion spring 154 is provided at one end of hinge 152. Second projectile guide member 144 includes an opening 156.

As shown in FIGS. 7A, 10, and 11, a wheel 158 protrudes through opening 156 of second projectile guide member 144. As shown in FIGS. 7A and 10, in embodiments, a finger 160 extends from the rim of wheel 158. In exemplary embodiments, finger 160 may be integrally formed with wheel 158. As shown in FIG. 11, in embodiments, wheel 158 is mechanically coupled to, and thus made to turn by, an electric motor 162 which is energized when the user pulls the trigger 128 of launcher 100.

In operation, prior to the time when a user pulls trigger 128, second projectile guide member 144 is disposed in a position that is defined by the unbiased position of torsion spring 154. When a user pulls trigger 128, motor 162 causes wheel 158 to turn. As wheel 158 turns, finger 160 periodically comes into contact with a bottom edge 164 of opening 156 of second projectile guide member 144. In embodiments, finger 160 and bottom edge 164 may have complementary beveled edges that facilitate contact therebetween. When finger 160 contacts bottom edge 164, finger 160 presses down on second projectile guide member 144, thereby winding torsion spring 154 as second projectile guide member 144 rotates downwardly on hinge 152.

Once finger 160 is no longer in contact with bottom edge 164 of opening 156, torsion spring 154 unwinds back to its unbiased position. In so doing, torsion spring 154 provides a return force to second projectile guide member 144, which causes second projectile guide member 144 to "kick" (i.e., lift) up slightly on hinge 152. This "kicking" up of second projectile guide member 144 is enough to shake the darts in hopper 114 loose so that one of them will fall into single dart chamber 146 at the bottom of hopper 114. As described above, once a dart falls in dart chamber 146, rotating track 148, with the assistance of reciprocating push rod 180, delivers the dart to flywheels 150*a*, 150*b*.

In embodiments, second projectile guide member 144 may include a horizontal ridge, and a cam mechanism may be coupled to the horizontal ridge to agitate second projectile guide member 144 to shake the darts in hopper 114 loose. It will be understood by those of ordinary skill in the art that any of a number of other means can be used to agitate second projectile guide member 144 in accordance with the present invention. In embodiments, first projectile guide member 140, rather than second projectile guide member 144, may be agitated to loosen the darts in hopper 114.

As they are being shaken loose by the "kicking" action of second projectile guide member 144, the darts tend to jump up and down within hopper 114. If the darts do not come back down with their tips pointing forward (i.e., toward barrel 106), they will not launch properly from launcher 100 and, consequently, their trajectories will be distorted. Specifically, the darts will not shoot far, and they will not shoot accurately.

In embodiments of launcher 100, cover 116 includes a collapsible ceiling assembly 166 which is attached to the underside of cover 116 by any suitable means that is well known to those of ordinary skill in the art, and thus will not be described further herein. In an exemplary embodiment shown in FIGS. 9 and 10, collapsible ceiling assembly 166 includes a plurality of nested members 168, 170, 172, 174, 176. When collapsible ceiling assembly 166 is collapsed, each one of nested members 168, 170, 172, 174 may be contained within the nested member that is immediately above it. When collapsible ceiling assembly 166 is fully collapsed against the underside of cover 116, nested members 168, 170, 172, 174 are all contained within nested member 168. A descending ceiling plate 178 in the collapsible ceiling assembly 166 is attached to nested member 176 by any suitable means that are well known to those of ordinary skill in the art and thus will not be described further herein. In embodiments, the shape of descending ceiling plate 178 will generally conform to the shape of hopper 114. In exemplary embodiments, descending ceiling plate 178 will have a generally square or rectangular shape.

Collapsible ceiling assembly 166 ensures that if the darts in hopper 114 jump up and down as a result of the "kicking" action of second projectile guide member 144, they come back down with their tips oriented properly, i.e., pointing forward toward barrel 106. Specifically, collapsible ceiling assembly 166 ensures the proper orientation of the darts in hopper 114 by preventing the darts from jumping up a distance that is greater than their length when they are agitated by the "kicking" action of second projectile guide member 144.

In operation, after darts have been loaded into hopper 114 and cover 116 and rear wall assembly have been locked into place in the manner described above, gravity causes collapsible ceiling assembly 166 to expand as nested members 170, 172, 174, 176 drop within the interior of hopper 114. As a result, descending ceiling plate 178 comes to rest on top of the pile of darts housed in hopper 114. The amount of weight applied to the pile of darts by descending ceiling plate 178 is heavy enough to prevent the darts from jumping up and down within hopper 114 while they are being agitated by the "kicking" action of second projectile guide member 144, but at the same time is light enough not to interfere with the "kicking" action of second projectile guide member 144 described above.

As a user fires darts from launcher 100, the level of darts inside hopper 114 drops. Nested members 170, 172, 174, 176 will drop further into the interior of hopper 114, in accordance with the drop in the level of darts inside hopper 114, so that descending ceiling plate 178 remains atop the pile of darts at all times when cover 116 is closed.

In the embodiments described above, there is a concern that when launcher 100 is loaded with darts 200 in hopper 114 and is turned away from an upright position, such as downwards, sideways or upside down, nested members 168, 170, 172, 174, 176 of ceiling 116 will collapse upward and the darts 200 that have already been organized in hopper 114 with the tips of the darts pointing toward the front of launcher 100 will shift and become jumbled.

Figure 12A:
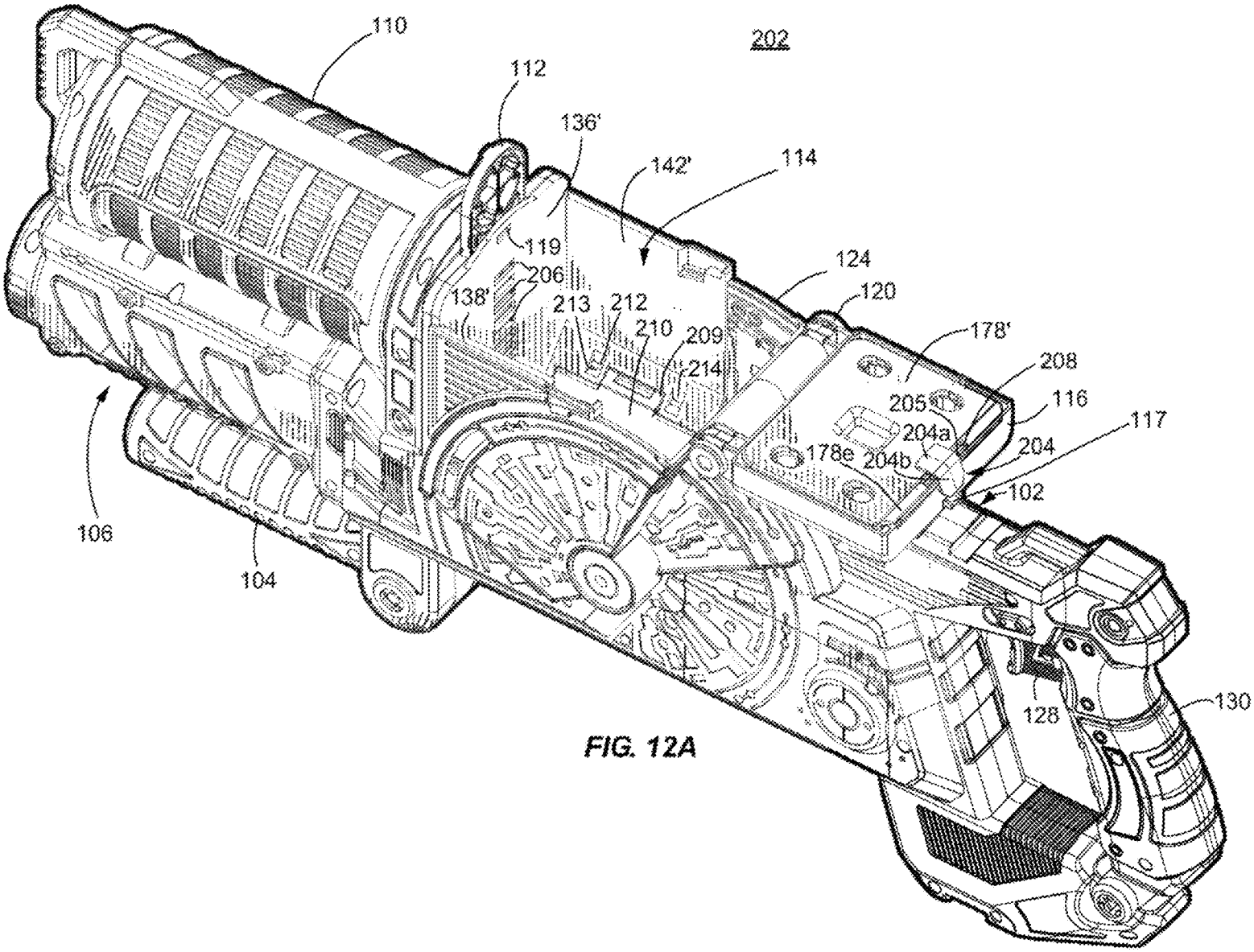
FIG. 12A depicts a toy projectile launcher, in accordance with additional exemplary embodiments of the present invention, that includes a catch for preventing the ceiling plate from collapsing (moving upward) within the hopper once the hopper cover is closed.
Figure 12B:
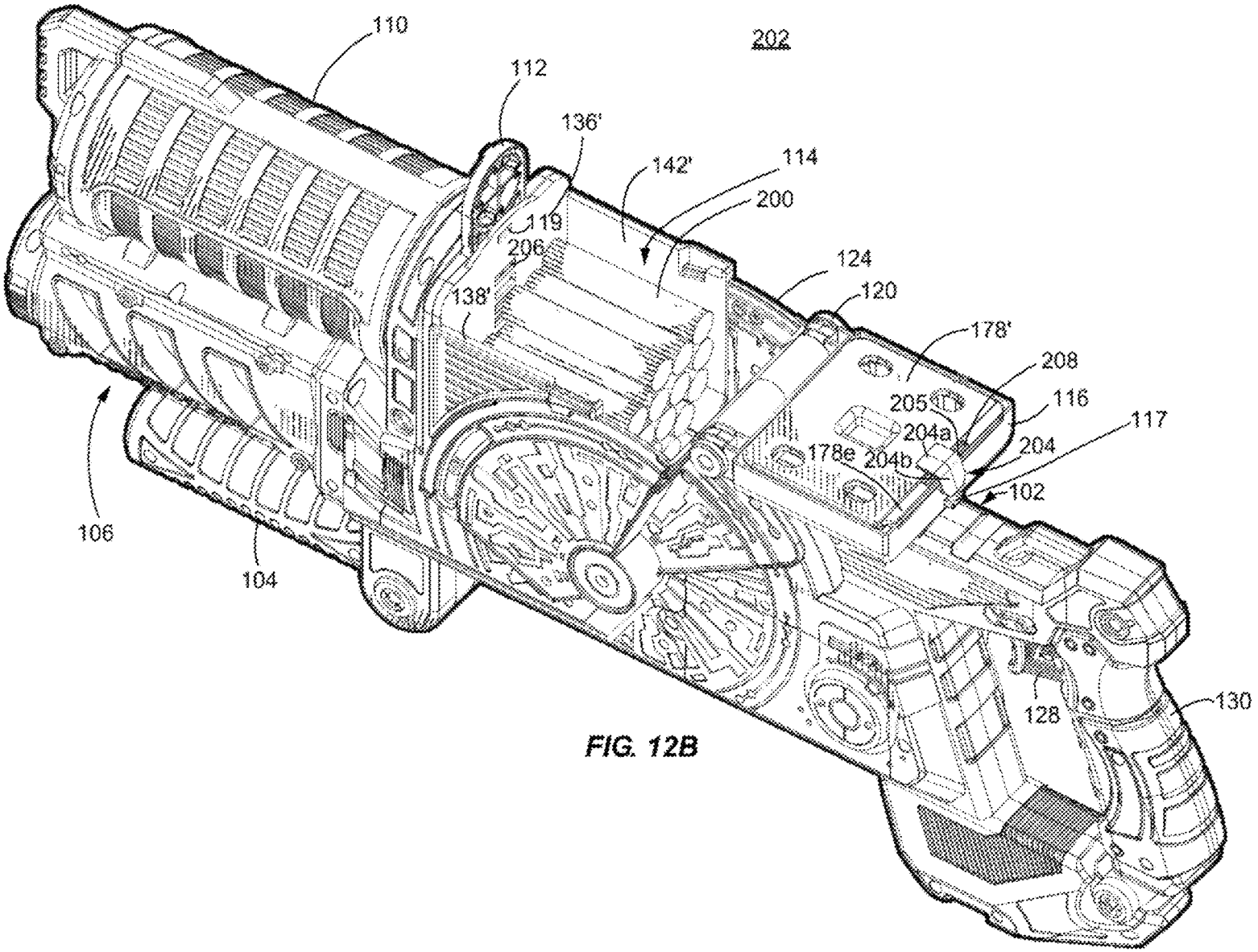
FIG. 12B depicts the toy projectile launcher of FIG. 12A after the hopper is loaded with darts and the hopper cover is open.
Figure 12C:
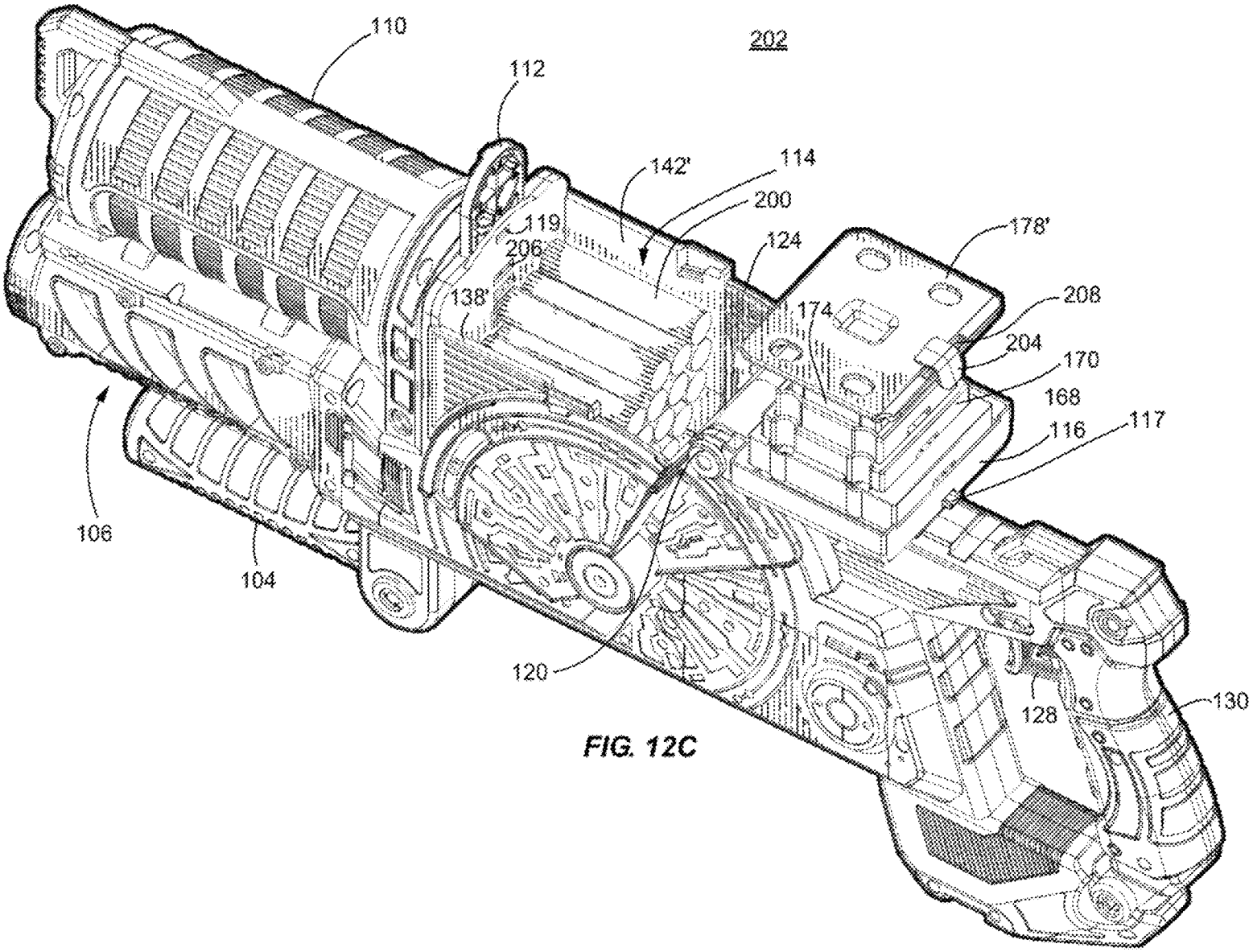
FIG. 12C depicts the toy projectile launcher of FIG. 12B in accordance with the additional exemplary embodiments of the present invention showing the nested members of the cover partially extended, with four nested members visible.

To address this concern, in additional exemplary embodiments, hopper 114 and cover 116 may be modified as shown with respect to launcher 202 in FIGS. 12A through 17B. Referring to FIGS. 12A, 12B, and 12C, launcher 202 is generally similar to launcher 100 with similar elements as indicated, but further includes a catch 204 coupled to the front of ceiling plate 178' that prevents upward movement of the collapsible ceiling assembly 166 but allows for downward expansion of the collapsible ceiling assembly 166. Catch 204, which may be a ratchet, operates in conjunction with a plurality of openings 206 that are spaced apart from one another and substantially vertically aligned, such as in a column, from an upper position to a lower position on front wall 136' of hopper 114. In embodiments, a column of openings 206 may, for example, be centered on front wall 136' below slot 119 for latch 117 on cover 116. In embodiments, catch 204 is coupled to descending ceiling plate 178' with a torsion spring 208 that is, for example, mounted over a rod that extends laterally across an interior surface 207*b* of descending ceiling plate 178'. In embodiments, descending ceiling plate 178' may include a curved extension 178*e* within which torsion spring 208 is retained.

Figure 13:
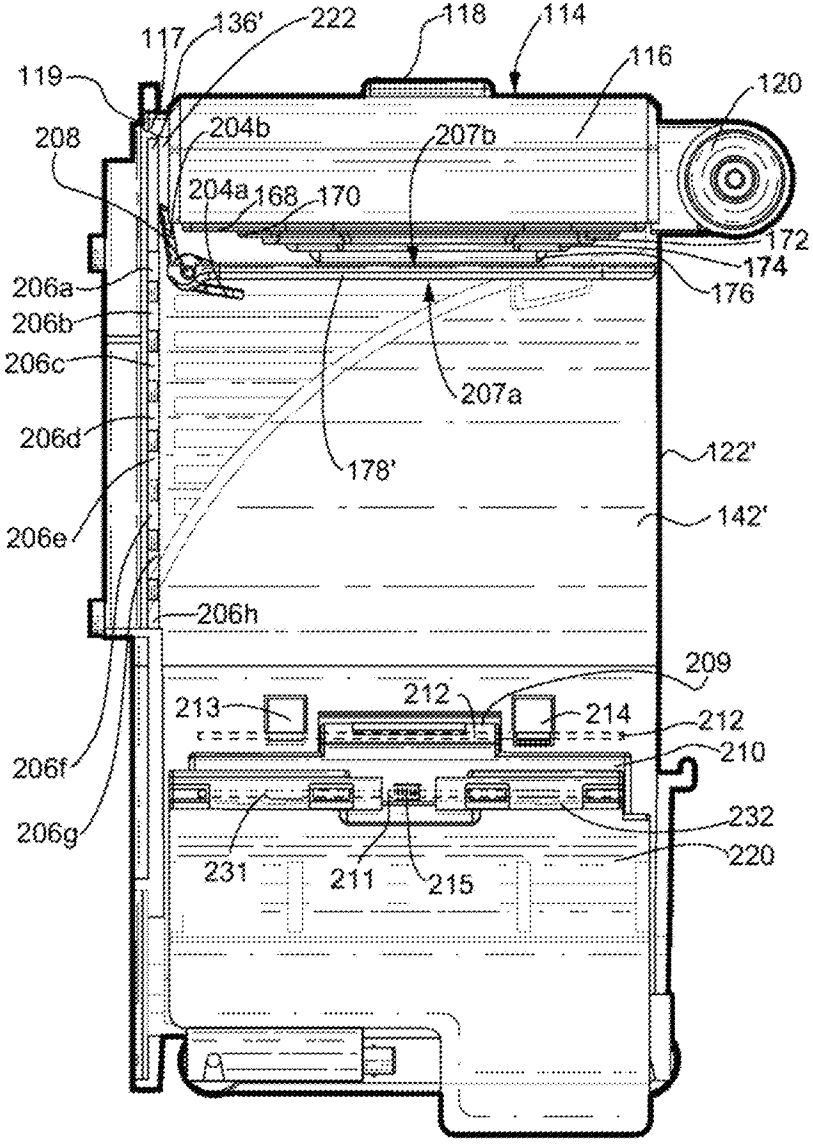
FIG. 13 depicts a plan view of the right side of closed hopper with a cutaway of the right hopper wall and the nested members substantially collapsed into a closed hopper in accordance with the additional exemplary embodiments of the present invention.

In embodiments, catch 204 includes a back end 204*a* and a front end 204*b* with a bend 205 therebetween that forms an obtuse angle between back end 204*a* and front end 204*b*. When cover 116 is open, back end 204*a* of catch 204 is coupled so as to be biased by spring 208 substantially against an exterior surface 207*a* of descending ceiling plate 178' and front end 204*b* of catch 204 is biased by spring 208 to be angled upward and forward toward the front of cover 116. In embodiments, when ceiling 116 is collapsed with nested members 168, 170, 172, 174, 176 nested inside one another, front end 204*b* projects upward in front of cover 116. As shown in FIG. 13, a space 222 may be provided between the front of cover 116 and front wall 136' of hopper 114 to accommodate second end 204*b* of catch 204.

There may be, for example, eight openings 206*a*, 206*b*, 206*c*, 206*d*, 206*e*, 206*f*, 206*g*, and 206*h* (from the top to the bottom of the hopper) in which catch 204 may engage, or there may be more or fewer then eight openings. In embodiments, openings 206 are spaced apart by a similar distance (e.g., 2 mm) or, in embodiments, openings 206 may be unevenly spaced.

Figure 14:
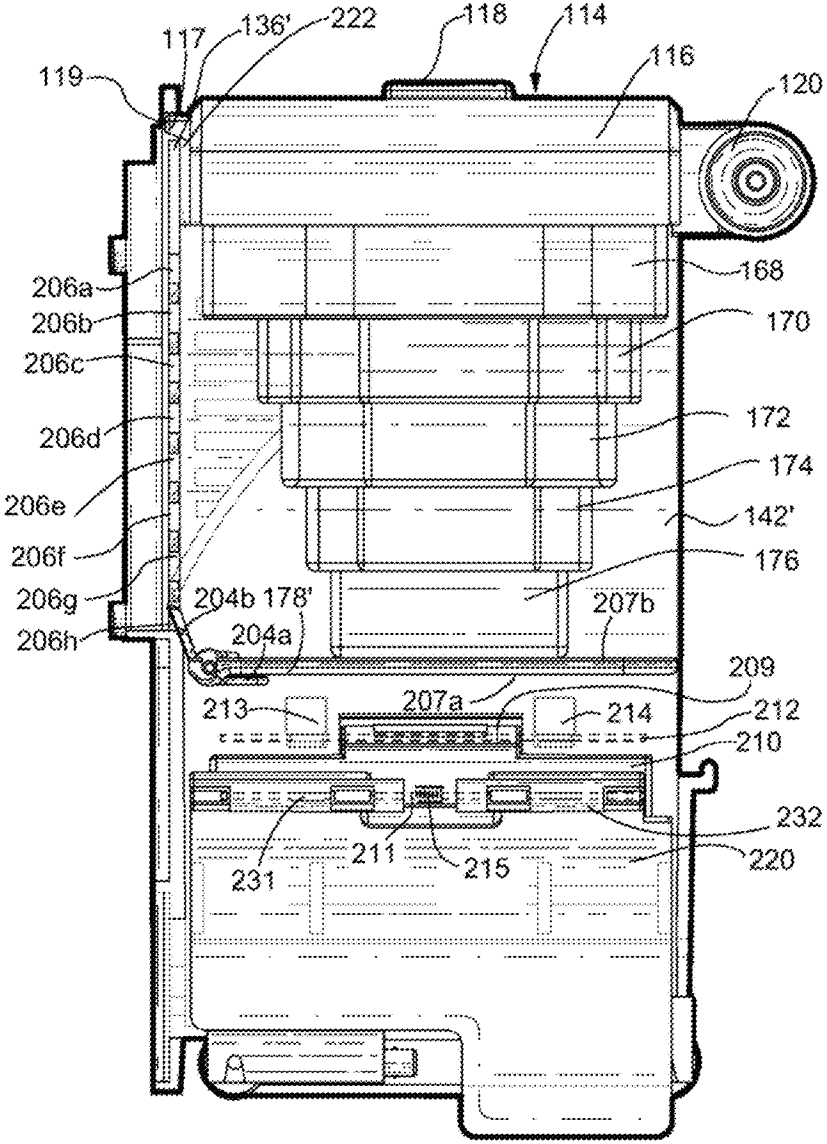
FIG. 14 depicts a plan view of the right side of closed hopper with a cutaway of the right hopper wall and the nested members substantially extended into a closed hopper in accordance with the additional exemplary embodiments of the present invention.

FIGS. 13 and 14 illustrate two of the various different positions of nested members 168, 170, 172, 174, 176 within hopper and catch 204, when cover 116 is closed on hopper 114. FIG. 13 illustrates one possible position of the nested members and catch 204 when hopper 114 is completely filled with darts (not shown) and FIG. 14 illustrates a second possible position of the nested members and catch 204 when there are relatively few darts (not shown) or no darts left in hopper 114.

Referring to FIG. 13, when hopper 114 is full, descending ceiling plate 178' is collapsed into cover 116, and catch 204 is located above top opening 206*a* on front wall 136' of hopper 114 as catch 204 may not be needed when hopper 114 is full to contain darts 200 in a desired position within hopper 114. However, as darts are launched from launcher 202, catch 204, descending ceiling plate 178' descends so that catch 204 engages the uppermost, first opening 206*a*. Then, when ceiling plate 178' further descends upon launching of additional darts, catch 204 disengages from first opening 206*a* and engages the next lower opening 206*b*. Next, ceiling plate 178' descends further when more darts are launched, and catch 204 disengages from opening 206*b* and engages opening 206*c*. This process continues for each consecutive lower opening 206*d*, 206*e*, 206*f*, 206*g* of openings 206 until the darts are greatly depleted from hopper 114, so that, as illustrated in FIG. 14 catch 204 is lowered to engage the lowest opening 206*h* on front wall 136'. As it descends between openings 206, front end 204*b* of catch 204 rotates backward about spring 208. Catch 204 is restored to a biased position about spring 208 when it enters a respective one of openings 206. Catch 204 is disengaged from whichever one of openings 206 in which it is engaged when movable rear wall assembly 124 is opened backward.

Figure 15A:
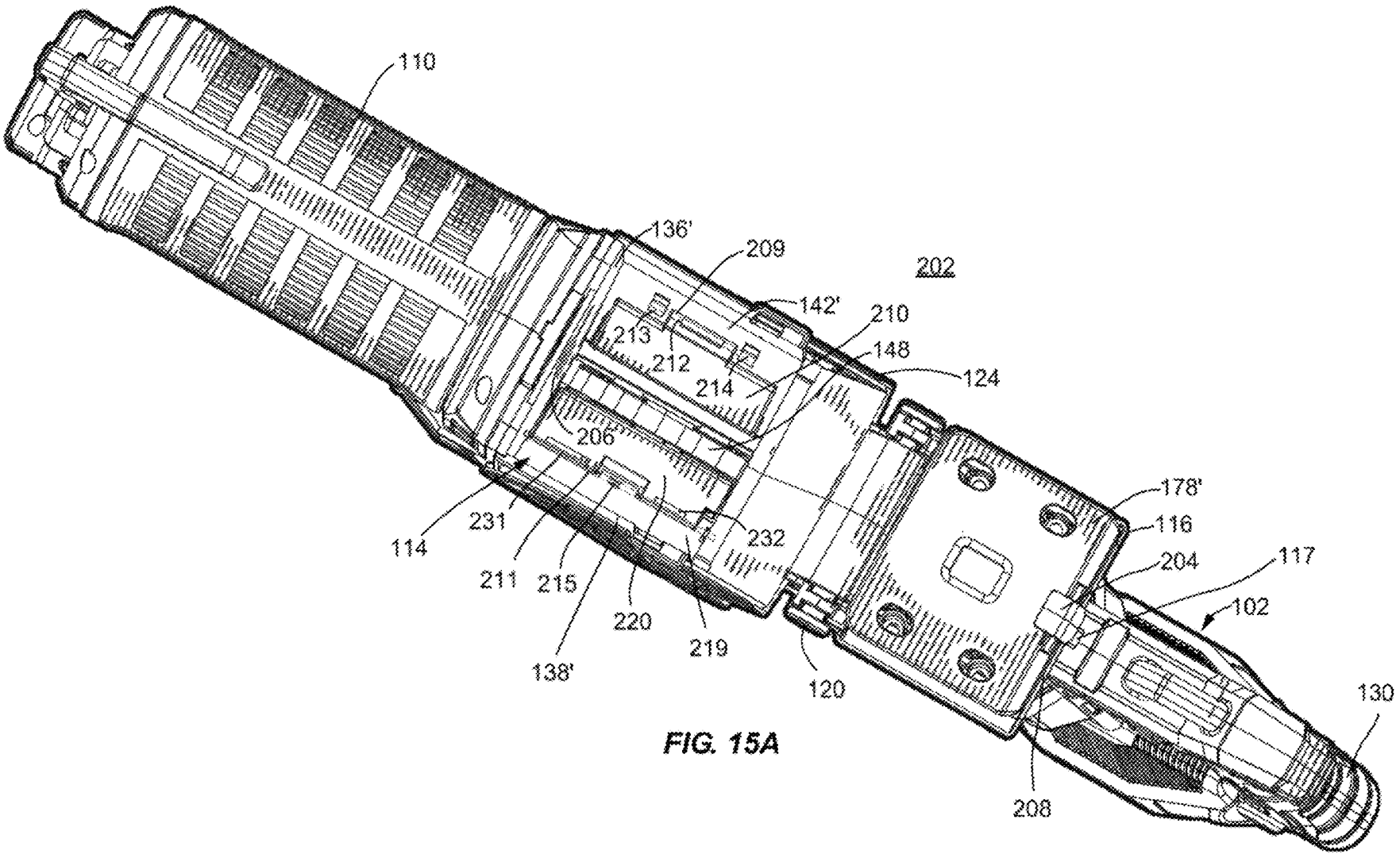
FIG. 15A shows a top view of the toy projectile launcher with the hopper cover open and the hopper, when empty of darts, in accordance with the additional exemplary embodiments of the present invention.
Figure 15B:
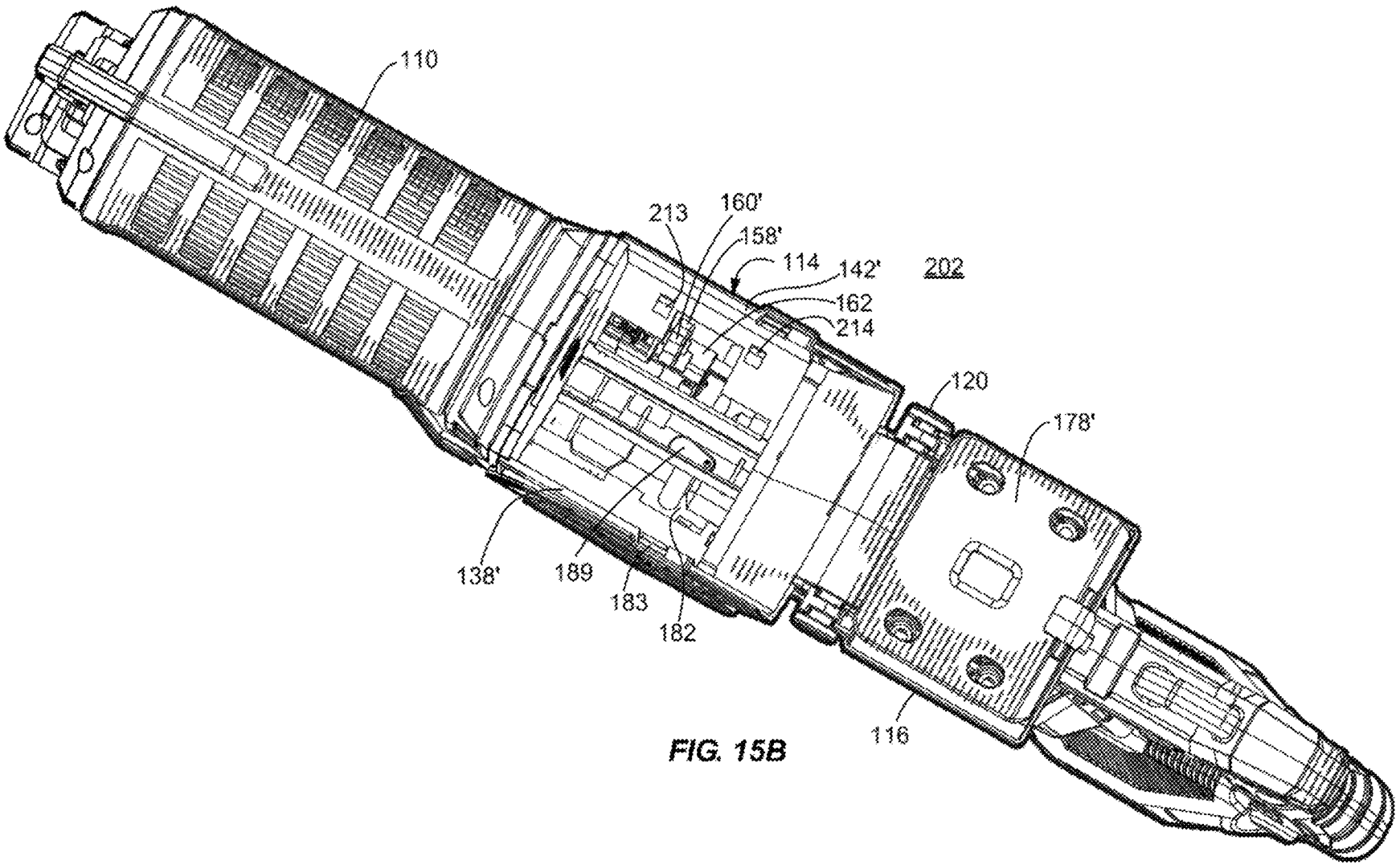
FIG. 15B shows a top view of the toy projectile launcher in accordance with the additional exemplary embodiments of the present invention with the hopper cover open and the first and second agitating members and the rotating rubber track removed.
Figure 15D:
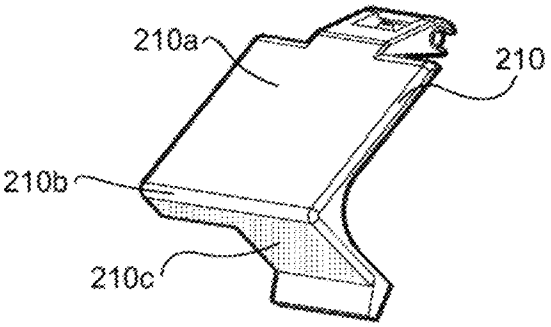
FIG. 15D shows a perspective view of the left side agitating member removed from FIG. 15B.
Figure 15C:
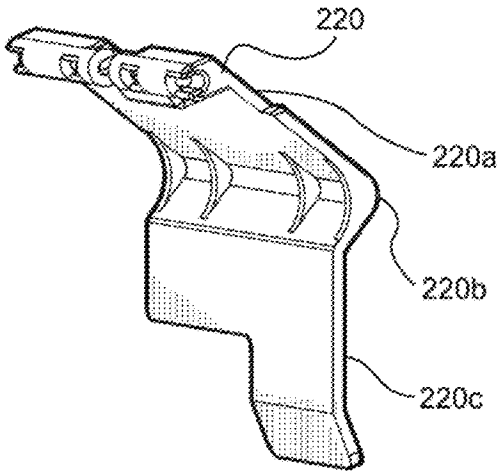
FIG. 15C shows a perspective view of the right side agitating member removed from FIG. 15B.

In addition to the addition of a catch 204, as shown in FIG. 15A, launcher 202 may also include at least two agitating members 210, 220, rather than just one agitating member (projectile guide member), to better agitate the darts to move downward toward firing chamber 146 for launch. A first agitating member 220 is associated with a left side wall 142' on the left side of hopper 114 and a second agitating member 210 is associated with a right side wall 138' on the right side of hopper 114. Each agitating member 210, 220 is provided with an agitating mechanism that agitates the respective agitating member. In embodiments, agitating members 210, 220 may each include an agitating panel, as shown in FIGS. 15C and 15D, that covers agitating mechanisms (described below) so that the agitating mechanisms for agitating members 210, 220 are not visible to a user and cannot come into contact with a user when hopper 114 is open. FIG. 15B shows launcher 202 with the agitating members 210, 220 removed to expose exemplary agitating mechanisms.

As shown in the embodiment in FIGS. 12A and 15, right and left side walls 138', 142' of hopper 114 in launcher 202 are configured somewhat differently from the configuration of launcher 100 that is illustrated in FIG. 7A.

Right side wall 138' of launcher 202 includes an upper portion that extends vertically and a lower portion that slopes inwardly toward rotating rubber track 148 and firing chamber 146. An opening in the sloped, lower portion of right side wall 138' exposes an agitating mechanism for the right side of hopper (and described below with reference to FIG. 16B) to agitate agitating member 220. In embodiments, agitating member 220 is connected with rod 211 to hinges 231, 232 at the top of agitating member 220, so as to cover at least a portion of the sloped, lower portion of wall 138' where the right side agitating mechanism is exposed. Rod 211 may also pass through a passage in wall 138' to strengthen the hinged connection of agitating member 220 to wall 138'. Agitating member 220 thus serves as a first projectile guide member.

An exemplary embodiment of agitating member 220 is shown in FIG. 15C and, may include a top section 220*a* that is visible in hopper 114, an inner middle section 220*b* that slopes backward and downward into housing 102, and a lower section 220*c*. Agitating member 220 may be biased downward by a torsion spring 215 inserted between wall 138' and agitating member 220 around rod 211. When a right side agitating mechanism, an embodiment of which is described below, makes contact with agitating member 220, the middle section 220B of agitating member 220 is caused by the agitating mechanism, to rise intermittently push upward and then return downward by the biased force of torsion spring 215.

Left side wall 142' includes an upper portion that extends vertically and a lower portion that slopes inwardly toward rotating rubber track 148 and firing chamber 146. An opening in the sloped, lower portion of wall 142' exposes a second agitating mechanism for the left side of hopper (and described below with reference to FIG. 17B) to agitate agitating member 210. In embodiments, agitating member 210 is connected with a rod 212 to hinge 209, at the top of plate 210, so that it covers at least a portion of the sloped, lower portion of wall 142' where the left side agitating mechanism is exposed. Agitating member 210 may be biased downward by a torsion spring (not shown) around rod 212. Rod 212 may also pass through passage 213, 214 on opposite sides of hinge 209 in wall 142' for strengthening the hinged connection of agitating member 210 to wall 142'.

An exemplary embodiment of agitating member 210 is shown in FIG. 15D. Agitating member 210 includes an upper portion 210*a*, a curved middle portion 210*b* that is generally biased downward within hopper 114, and a lower portion 210*c*. Agitating member 210 may be agitated by a left side agitating mechanism, an embodiment of which is described below. When agitating member 210 makes contact with the underside of agitating member 210 such as at a lower portion 210*c* of agitating member 210, agitating member 210 is intermittently pushed upward and agitating member 210 agitates darts in hopper 114. Agitating member 210 thus serves as a second projectile guide member.

Agitating members 210, 220 may be agitated by similar or different agitating mechanisms. In embodiments, the particular agitating mechanisms that are used may be selected based in part on agitating forces and/or space constraints within housing 102.

Figure 16A:
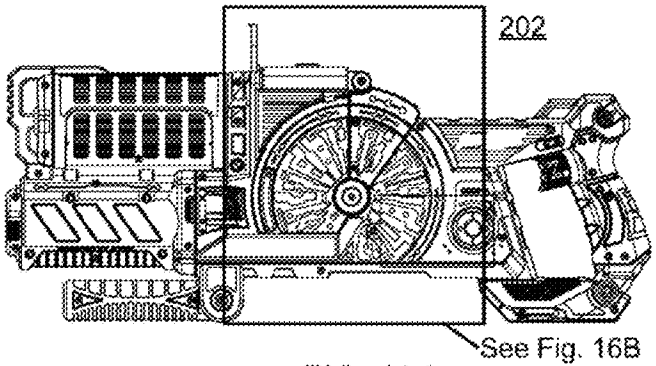
FIG. 16A shows a right side view of the toy projectile launcher in accordance with the additional exemplary embodiments of the present invention and indicates a portion of the toy projectile launcher shown in more detail in FIG. 16B.
Figure 16B:
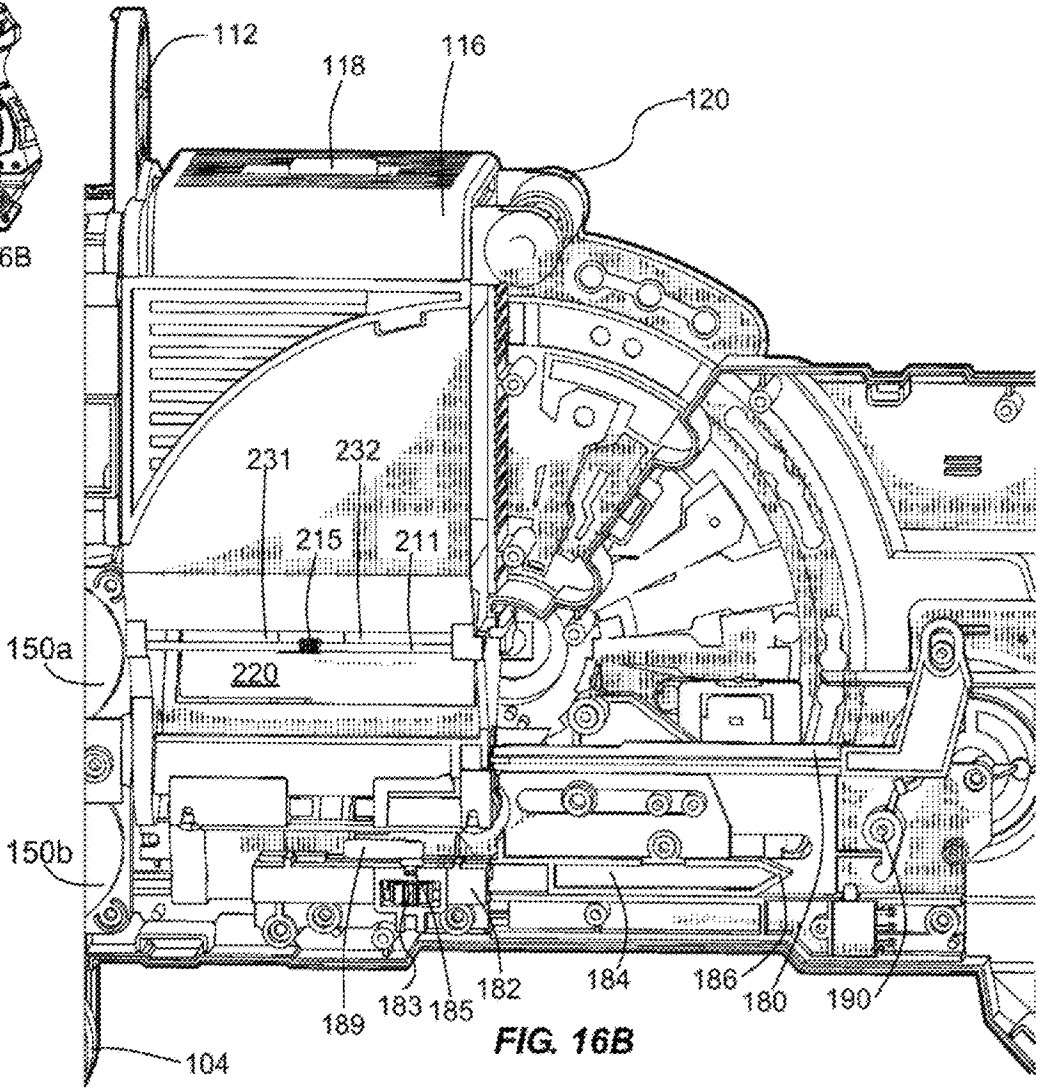
FIG. 16B shows an aligned partial right side view of the toy projectile launcher with a bottom section of the launcher cutaway in accordance with the additional exemplary embodiments of the present invention.
Figure 17B:
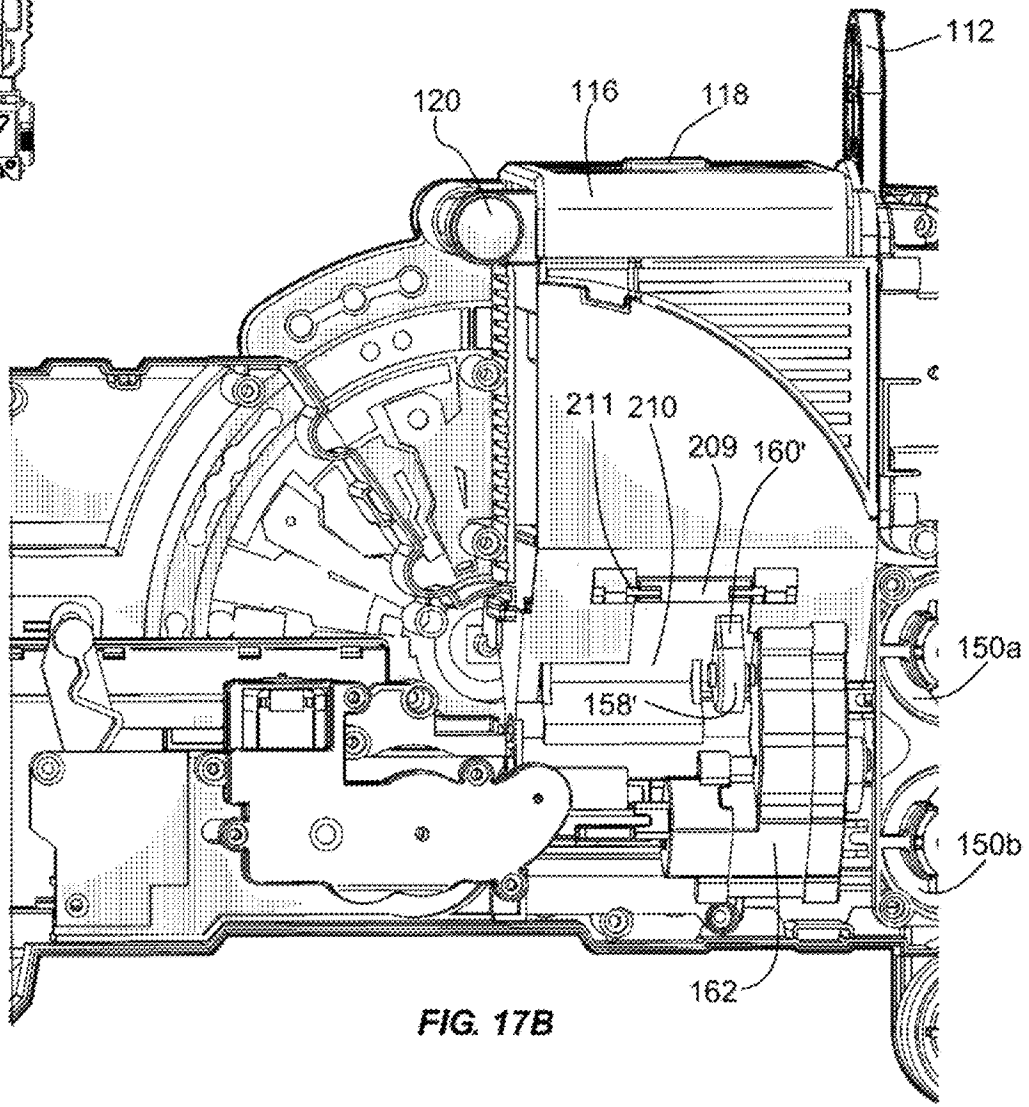
FIG. 17B shows an aligned partial left side view of the toy projectile launcher with a bottom section of the launcher cutaway in accordance with the additional exemplary embodiments of the present invention.
Figure 17A:
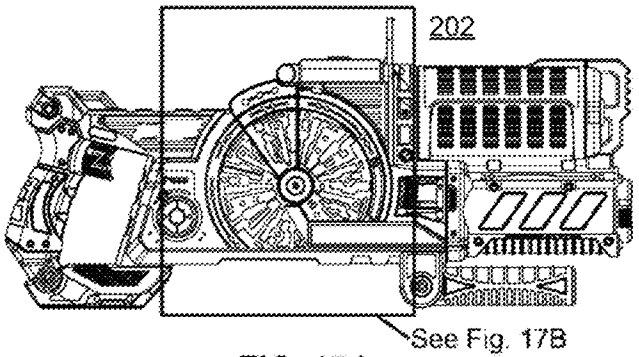
FIG. 17A shows a left side view of the toy projectile launcher in accordance with the additional exemplary embodiments of the present invention and indicates a portion of the toy projectile launcher shown in more detail in FIG. 17B.

In an exemplary embodiment shown in FIGS. 16B and 17B, different agitating mechanisms are used. FIG. 16B shows an example of a first agitating mechanism on the right side of hopper 114 that may be used to agitate agitating member 220 and FIG. 17B shows an example of a second agitating mechanism on the left side of hopper 114 that may be used to agitate agitating panel 210.

An exemplary embodiment of a first agitating mechanism is shown in FIGS. 15B and 16B. In embodiments, the first agitating mechanism may include a wheel (e.g., a gear) 183 coupled via a shaft 185 to an arm 189 that is rotatable about shaft 185. Arm 189 causes agitation by coming into intermittent contact with the underside of agitating member 220. In embodiments, the rotation may proceed in a single direction or, in embodiments, wheel 183 may be driven to oscillate so that it rotates first in one of a clockwise direction and a counterclockwise direction and then in the reverse direction. Wheel 183 is driven by a motor which, in embodiments, may be a motor dedicated to driving wheel 183 or may be coupled to a motor used to power another motorized component in launcher 202, such as a motor for driving rotating rubber track 148.

In operation, before a user pulls trigger 128, agitating member 220 is disposed in a first, lowered position. Upon a user pressing trigger 128, wheel 183 is driven to be rotated. When wheel 183 rotates, arm 189 periodically contacts the underside of agitating member 220, thereby causing the agitation of agitating member 220 to agitate the right side of hopper 114.

In particular, agitating member 220 is "kicked" up by each contact with arm 189 causing agitating member 220 to rotate upward about hinges 231, 232. When arm 189 moves out of contact with agitating member 220, agitating member 220 returns downward. This "kicking" up of agitating member 220 works in conjunction with agitating member 210 to shake the darts in hopper 114 loose so that one of them will fall into firing chamber 146 at the bottom of hopper 114. In embodiments, the same type of agitating mechanism may be used to agitate agitating member 210 in lieu of the second agitating mechanism, described below.

An exemplary embodiment of a second agitating mechanism, that may be used for example to agitate agitating member 210, is shown in FIGS. 15B and 17B. In embodiments, the second agitating mechanism may include a rotating wheel 158', similar to wheel 158 in the embodiments shown with respect to FIG. 7A, having a finger 160' that periodically contacts the underside of agitating member 210 as wheel 158', thereby causing the agitation of agitating member 210.

In operation, before a user pulls trigger 128, agitating member 210 is disposed in a first, lowered position. When a user pulls trigger 128, motor 162 causes wheel 158 to turn. As wheel 158' turns, finger 160' periodically comes into contact with a location near the bottom of agitating member 210. When finger 160' contacts agitating member 210, "kicks" up the bottom of agitating member 210 causing agitating member 210 to rotate upward about hinge 211. When finger 160' moves out of contact with agitating member 210, agitating member 210 returns downward. This "kicking" up of agitating member 210 works in conjunction with agitating member 220 to shake the darts in hopper 114 loose so that one of them will fall into firing chamber 146 at the bottom of hopper 114. In embodiments, the same type of agitating mechanism may be used to agitate agitating member 220 in lieu of the first agitating mechanism having a wheel 183 and related components.

In exemplary embodiments, agitating members 210, 220 may be sequentially activated with agitation of the hopper alternating between agitation by agitating member 210 and agitation by agitating member 220. Thus, a first one of the agitating members 210, 220 agitates, then a second one of the agitating members 210, 220 agitates, then the first agitating member agitates, etc. Sequential activation may be achieved by various known methods such as, for example, by controlling motor speeds for and sizing of the agitating mechanisms so that both agitating members 210, 220 do not agitate at the same time.

Also, in exemplary embodiments, agitating members 210, 220 may be substantially simultaneously agitated. In other embodiments, agitating members 210, 220 may be configured to sometimes agitate agitating members 210, 220 simultaneously and to sometimes agitate agitating members 210, 220 sequentially.

In embodiments, the first and second agitating mechanisms may be independently controlled so that one agitating mechanism may be disabled. In other embodiments, a single agitating mechanism may be used to agitate two agitating members, whether simultaneously or sequentially.

In embodiments, there may also be more than two agitating members included in a hopper 114.

It should be understood that while they are illustrated in the context of launcher 202, the use of dual agitating members and mechanisms is a feature that may be implemented with or independently of the presence of a catch 204 for preventing a collapse of the collapsible ceiling assembly 166. Likewise, the use of a catch 204 may be implemented where a hopper has only a single agitating member and agitating mechanism.

As described above with respect to the exemplary embodiments described with respect to FIGS. 1 to 11, once a dart falls in dart chamber 146, rotating rubber track 148, with the assistance of reciprocating push rod 180, delivers the dart to flywheels 150*a*, 150*b* to launch the dart.

In additional exemplary embodiments, the hopper may be detachable, as shown with respect to toy projectile launcher 300 in FIGS. 18-32 and described below. The embodiment of launcher 300 shown in FIGS. 18-32 and described below is a battery-operated flywheel launcher. In alternative embodiments, a detachable hopper can be implemented in a manual, air-piston-driven toy projectile launcher with appropriate modifications that would be readily apparent to a person having ordinary skill in the art.

Figure 18:
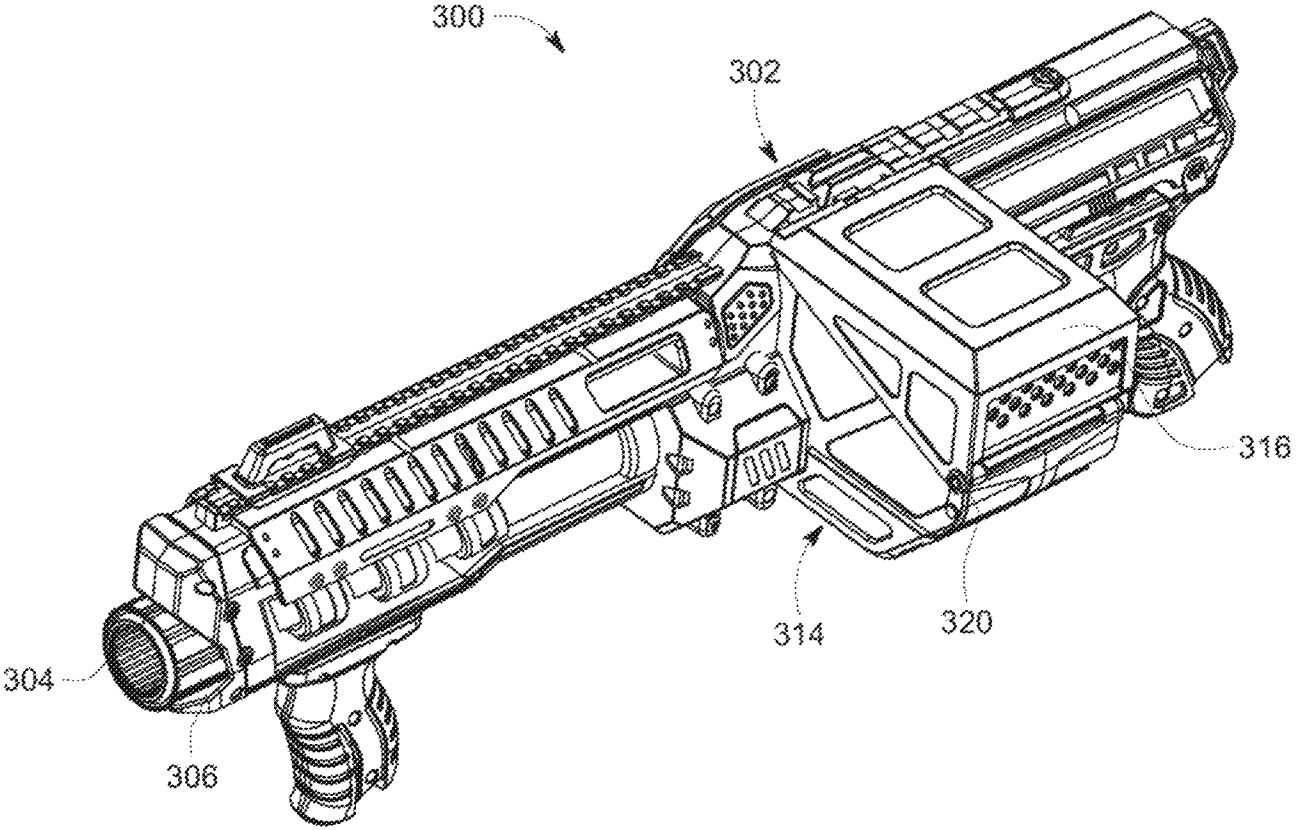
FIG. 18 shows a top, left side perspective view of a toy projectile launcher in accordance with additional exemplary embodiments of the present invention that includes a detachable hopper.
Figure 19:
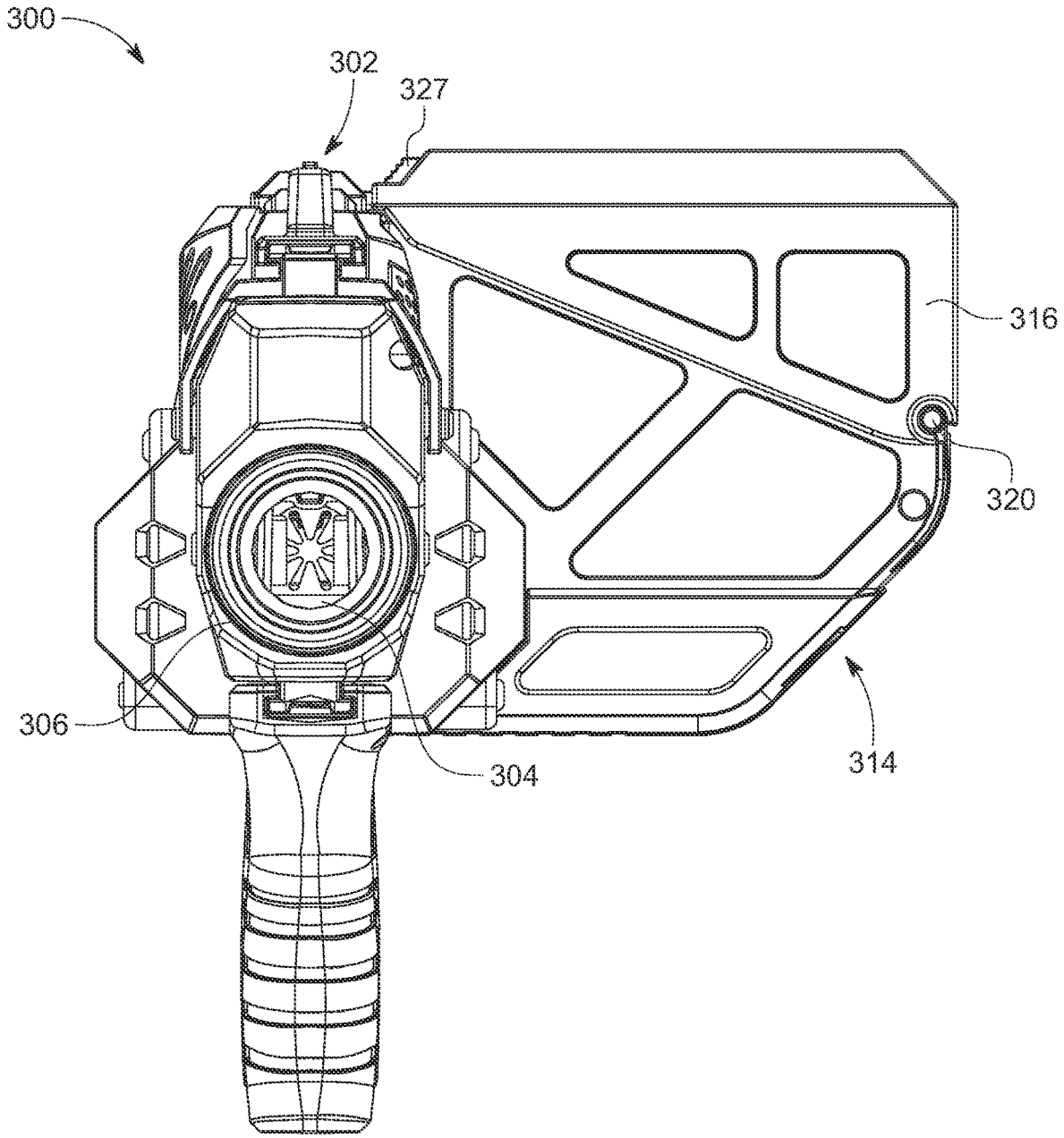
FIG. 19 shows a front view of the toy projectile launcher shown in FIG. 18.
Figure 20:
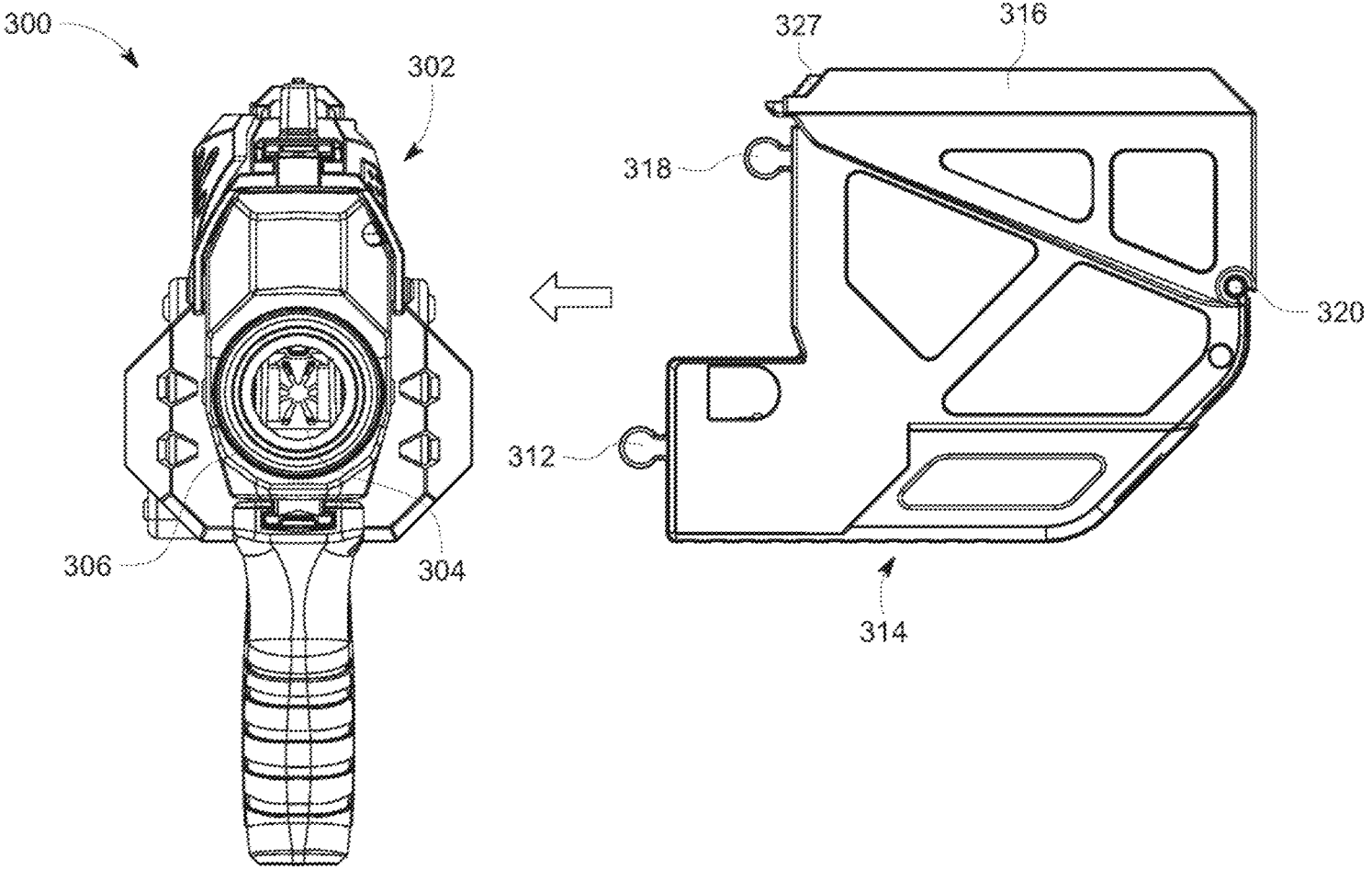
FIG. 20 shows a front view of the toy projectile launcher shown in FIGS. 18 and 19 with the hopper detached from the housing of the toy projectile launcher.

Referring to FIGS. 18 and 19, toy projectile launcher 300 includes a detachable hopper 314. A cover 316 sits atop hopper 314 and is rotatably coupled to hopper 314 by hinge 320. Cover 316 is rotated around hinge 320 to enable darts to be placed inside hopper 314. As shown in FIG. 20, hopper 314 is insertable into an opening (not shown) on one side of housing 302 of launcher 300. FIG. 20 illustrates an embodiment in which hopper 314 is inserted into the right side of housing 302 of launcher 300 (as viewed when looking into the barrel 306 of launcher 300). In alternative embodiments of launcher 300, hopper 314 can be inserted into the left side of housing 302 (as viewed when looking down the barrel 306 of launcher 300).

Figure 21:
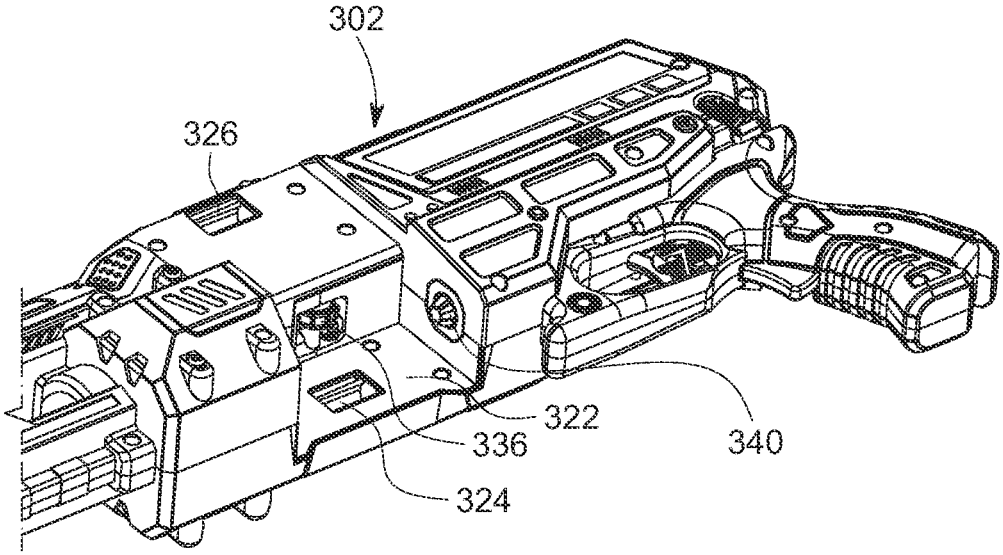
FIG. 21 shows a partial perspective view of the housing of a toy projectile launcher in accordance with additional exemplary embodiments of the present invention which shows an opening into which the detachable hopper is inserted.
Figure 22:
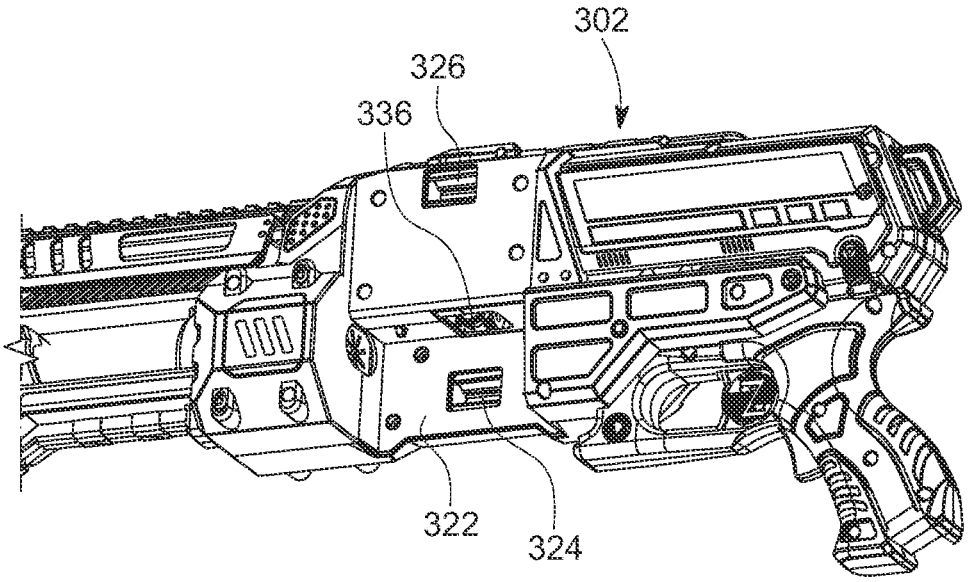
FIG. 22 shows another partial perspective view of the housing of a toy projectile launcher in accordance with additional exemplary embodiments of the present invention which shows an opening into which the detachable hopper is inserted.

FIGS. 21 and 22 show two views of the opening 322 of housing 302 into which the detachable hopper 314 is inserted. Detachable hopper 314 is inserted into opening 322 and is secured to housing 302 as protuberance 312 formed on hopper 314 is inserted into its corresponding receptacle 324 in housing 302 and protuberance 318 formed on hopper 314 is inserted into its corresponding receptacle 326 in housing 302. Cover 316 includes a releasable latch 327 which locks cover 316 in place when it is closed.

Figure 23:
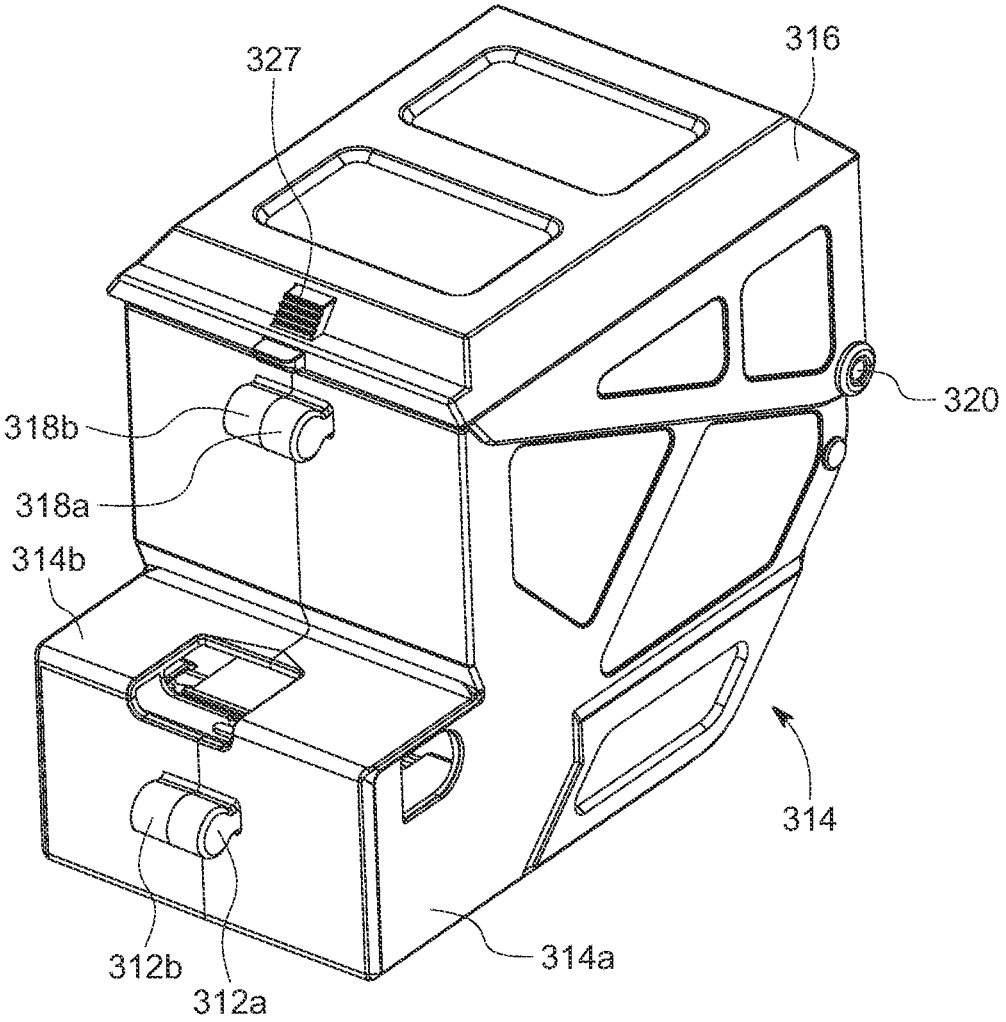
FIG. 23 shows a perspective view of a detachable hopper in accordance with additional exemplary embodiments of the present invention.

In embodiments, detachable hopper 314 may be made by combining two pieces 314*a* and 314*b*, as shown in FIG. 23. Piece 314*a* may include protuberances 312*a* and 312*b*, which when combined as shown in FIG. 23 would form the protuberance 312 which is received into receptacle 324 of housing 302 when detachable hopper 314 is inserted into opening 322 of launcher housing 302. Likewise, piece 314*b* may include a lower protuberance 312*b* and an upper protuberance 318*b*, which when combined as shown in FIG. 23 would form the protuberance 318 which is received into receptacle 326 of housing 302 when detachable hopper 314 is inserted into opening 322 of launcher housing 302.

Figure 24:
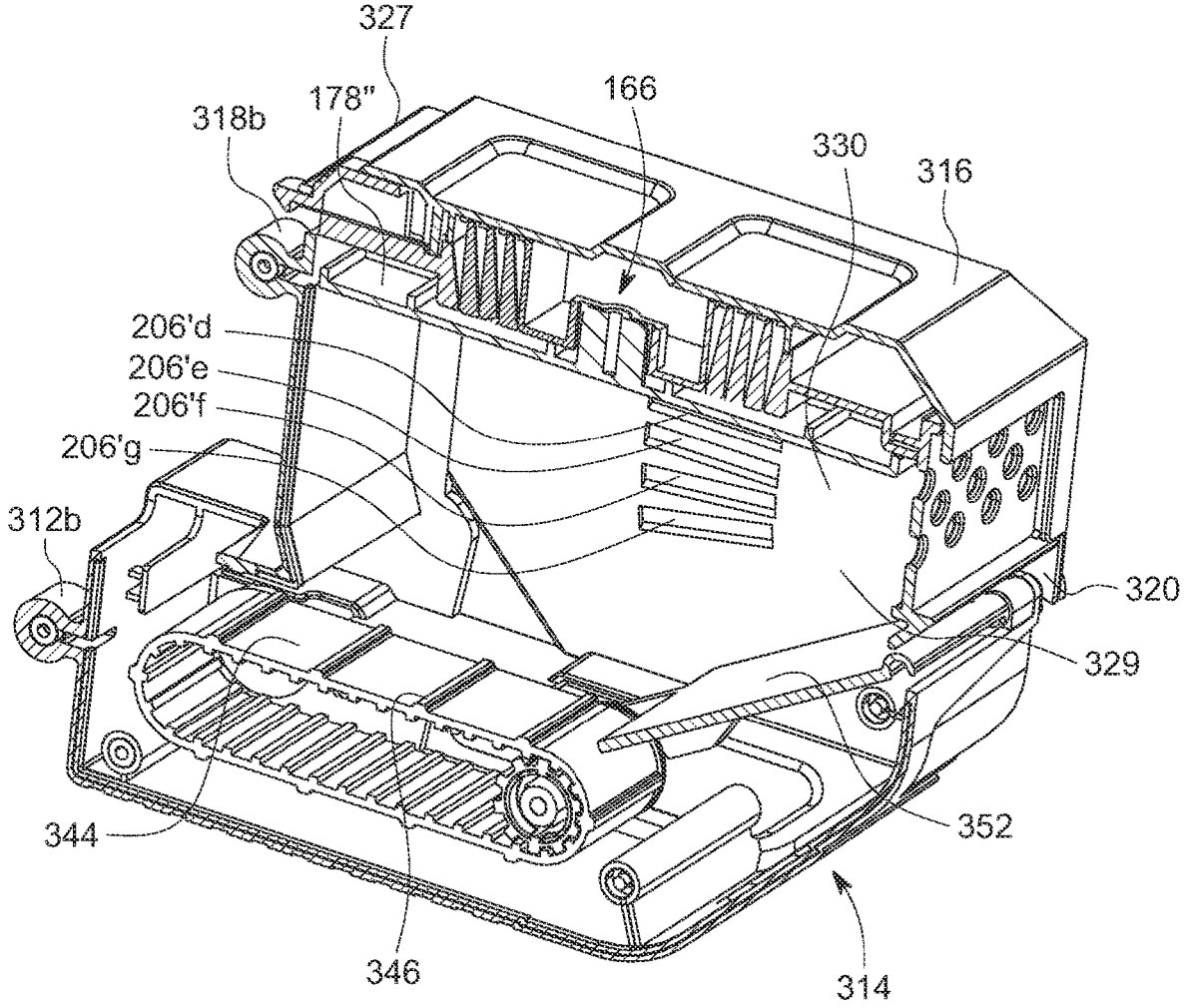
FIG. 24 shows a perspective, cross-sectional view of the detachable hopper shown in FIG. 23.
Figure 25:
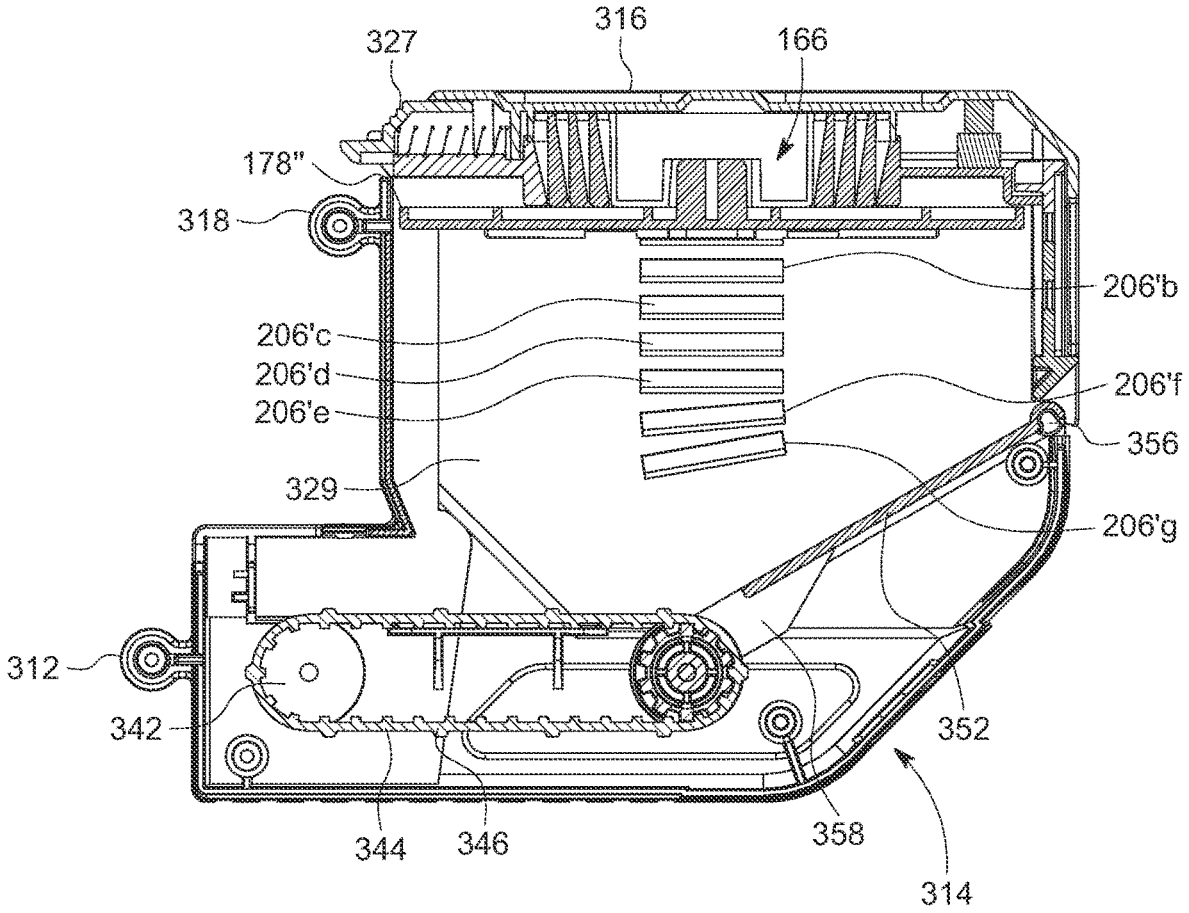
FIG. 25 shows a cross-sectional view of the detachable hopper shown in FIG. 23.

Cross-sectional views of an empty detachable hopper 314 and cover 316 are shown in FIGS. 24 and 25. Detachable hopper 314 includes a rotating rubber belt 344 which delivers darts from hopper 314 to an interior recess (which may include a firing chamber) in the housing 302 of launcher 300. The surface of rubber belt 344 may include ridges 346 to facilitate delivery of darts from hopper 314 to the firing cavity in housing 302 of launcher 300 by rubber belt 344. Detachable hopper 352 also includes an agitating member 352. As described in detail below, the rotation of the rubber belt 344 will impart a flapping motion to agitating member 352. This flapping of agitating member 352 agitates darts 200 within detachable hopper 314 to facilitate their orderly descent within the hopper 314.

Collapsible ceiling assembly 166 is attached to the underside of cover 316 by any suitable means. Descending ceiling plate 178" is attached to the collapsible ceiling assembly 166 and, as described in detail below, descends, by gravity, as consecutive darts are launched from launcher 300. Opposite walls 329, 333 of detachable hopper 314 may also contain a plurality of openings/slots 206'*a*-206'*g* formed therein. Openings 206'*a*-206'*g* are spaced apart from one another and are substantially vertically aligned, such as in a column, from an upper position to a lower position on each of walls 329, 333 of hopper 314. In embodiments, a column of openings 206'*a*-206'*g* may, for example, be centered on each wall 329, 333. As described in detail below, the openings/slots 206'*a*-206'*g* interact with the ceiling plate 178" to prevent the ceiling plate 178" from collapsing up into the underside of cover 314 when launcher 300 is tilted, or placed upside down.

Figure 26:
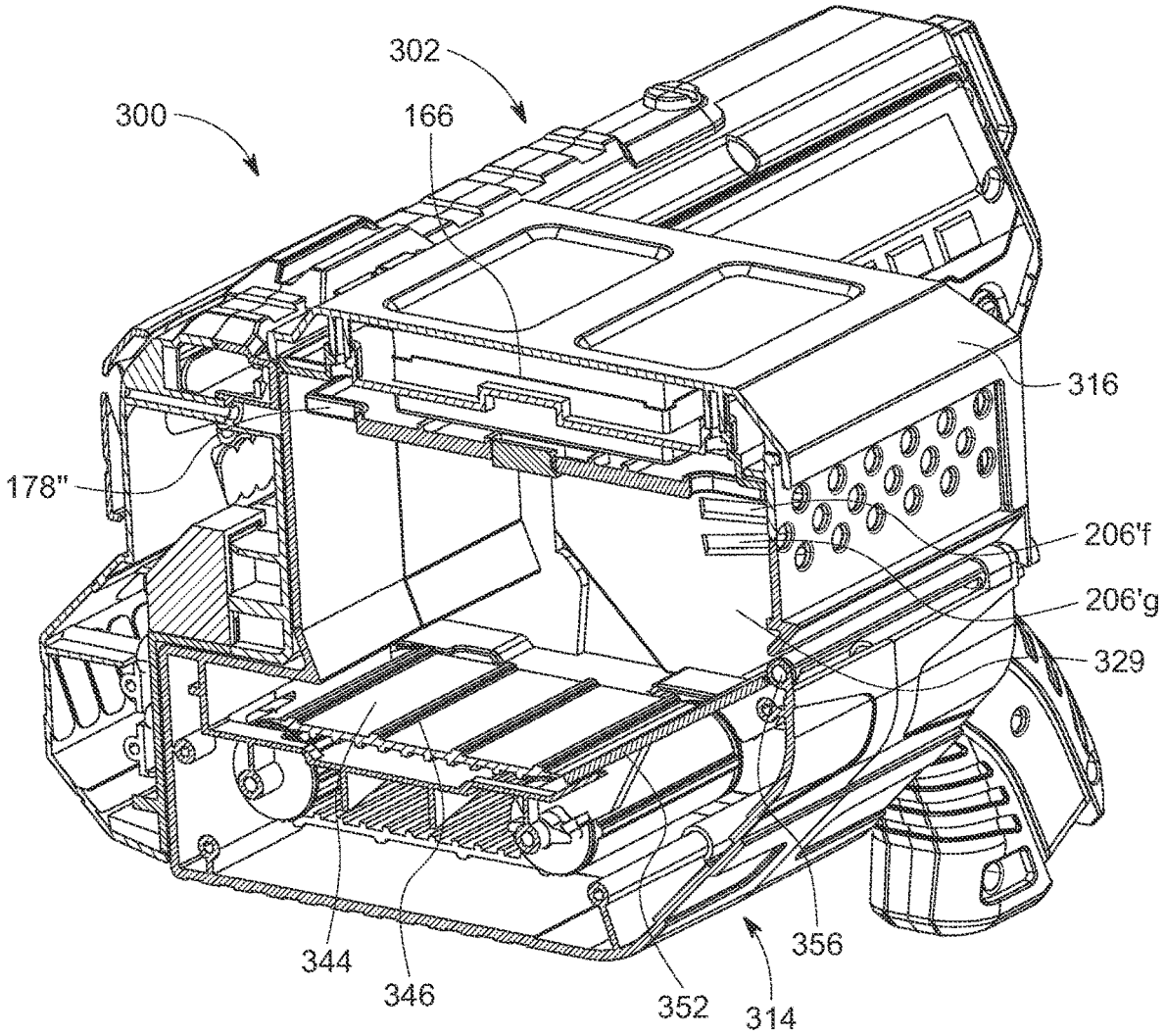
FIG. 26 shows a perspective, cross-sectional view of a toy projective launcher in accordance with additional exemplary embodiments of the present invention which shows the detachable hopper attached to the housing as viewed from the barrel end of the toy projectile launcher.
Figure 27:
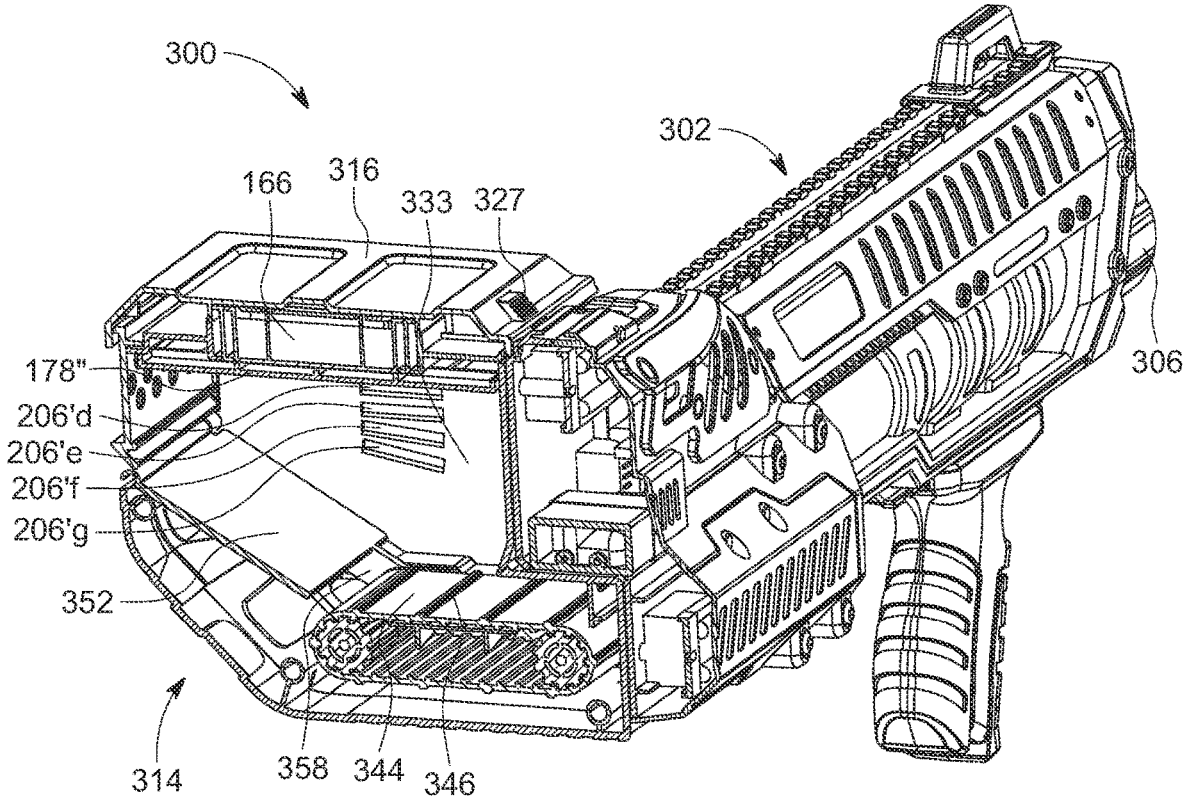
FIG. 27 shows a perspective, cross-sectional view of a toy projectile launcher in accordance with additional exemplary embodiments of the present invention with the detachable hopper attached to the housing as viewed from the trigger end of the toy projectile launcher.

FIG. 26 shows a cross-sectional view of launcher 300 with hopper 314 attached to housing 302 as viewed from the barrel end of launcher 300. FIG. 27 shows a cross-sectional view of launcher 300 with hopper 314 attached to housing 302 as viewed from the trigger end of launcher 300.

Figure 29:
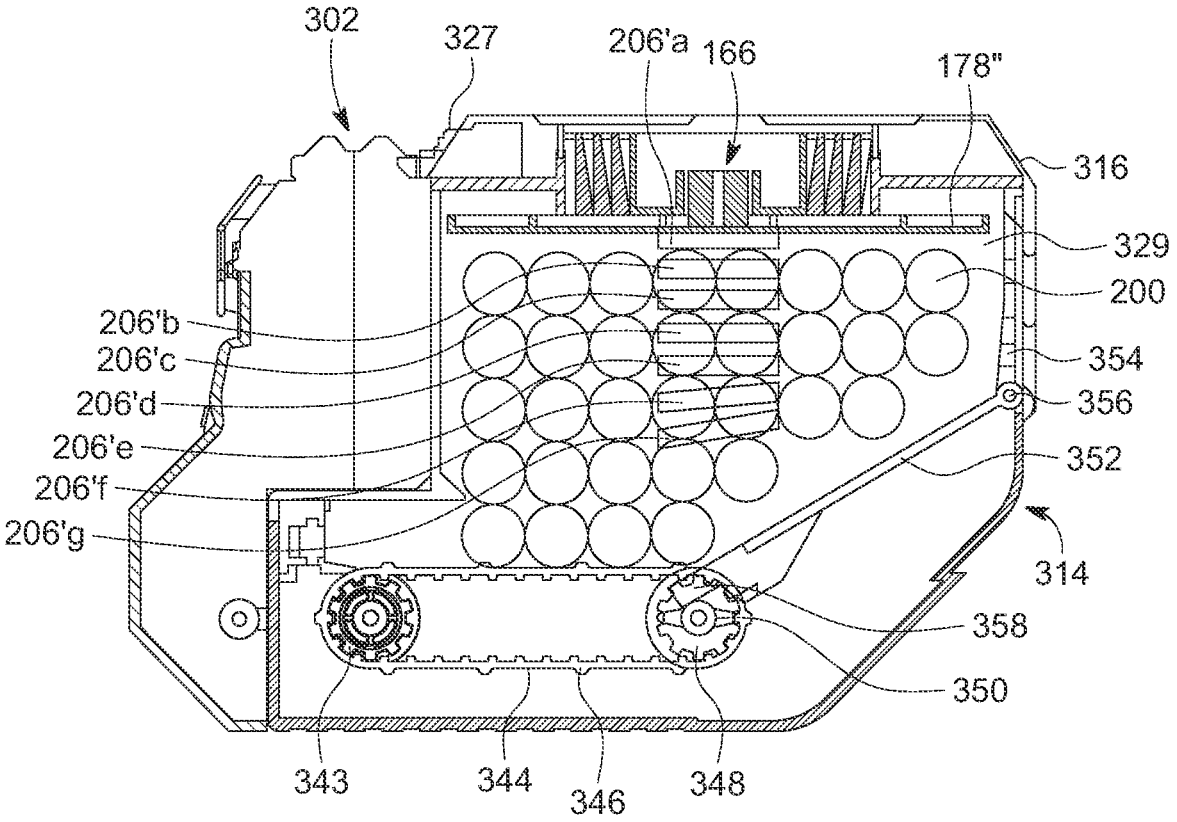
FIG. 29 shows a side cross-sectional view of the detachable hopper of FIG. 23 filled with toy projectiles (e.g., foam darts) and a first possible position of a collapsible ceiling assembly which is attached to the underside of the cover of in accordance with additional exemplary embodiments of the present invention.

As illustrated in FIGS. 26 and 27, in embodiments, walls 329, 333 of detachable hopper 314 are disposed opposite one another and each wall includes a series of seven vertical openings/slots 206'*a*-206'*g* (from the top to the bottom of the hopper). (All of openings/slots 206'*a*-206'*g* are shown in FIG. 29.) In embodiments, there may be more or fewer then seven openings. In embodiments, openings 206'*a*-206'*g* are spaced apart by a similar distance (e.g., 2 mm) or, in embodiments, all or some of openings 206'*a*-206'*g* may be unevenly spaced.

Figure 28A:
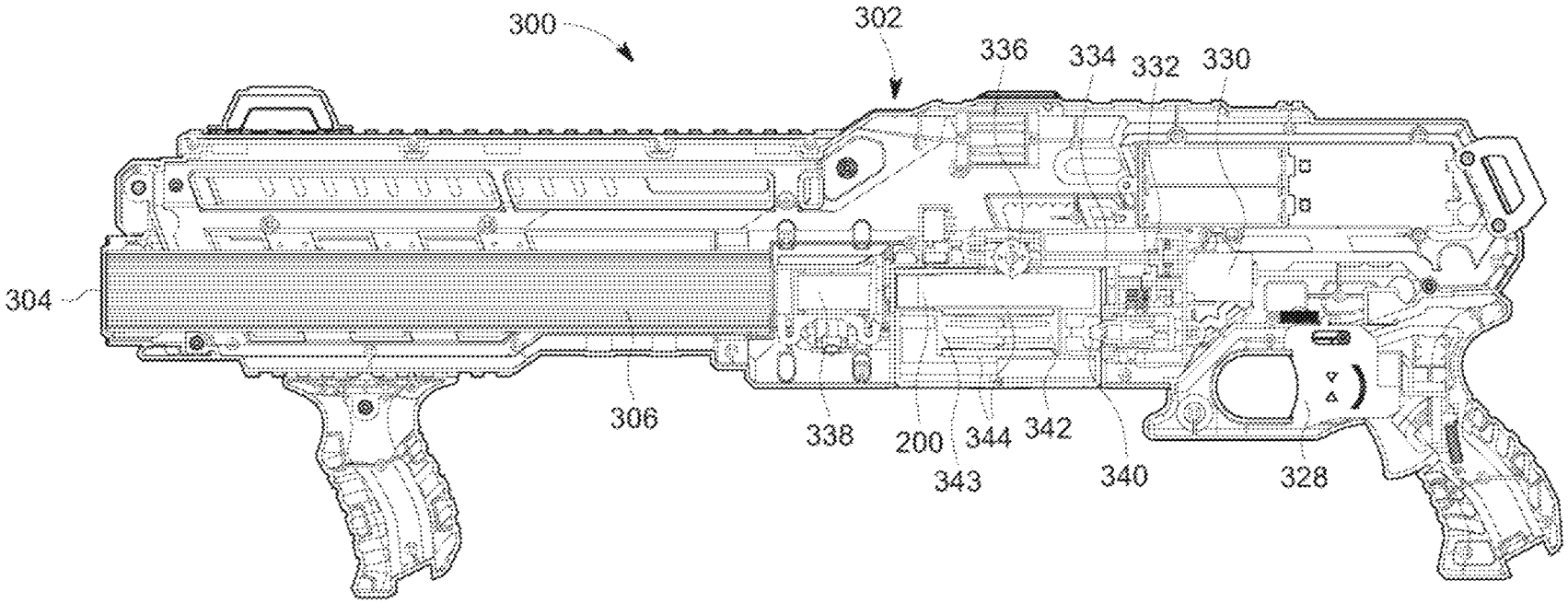
FIG. 28A shows a side, cross-sectional view of the toy projectile launcher shown in FIG. 18.
Figure 28B:
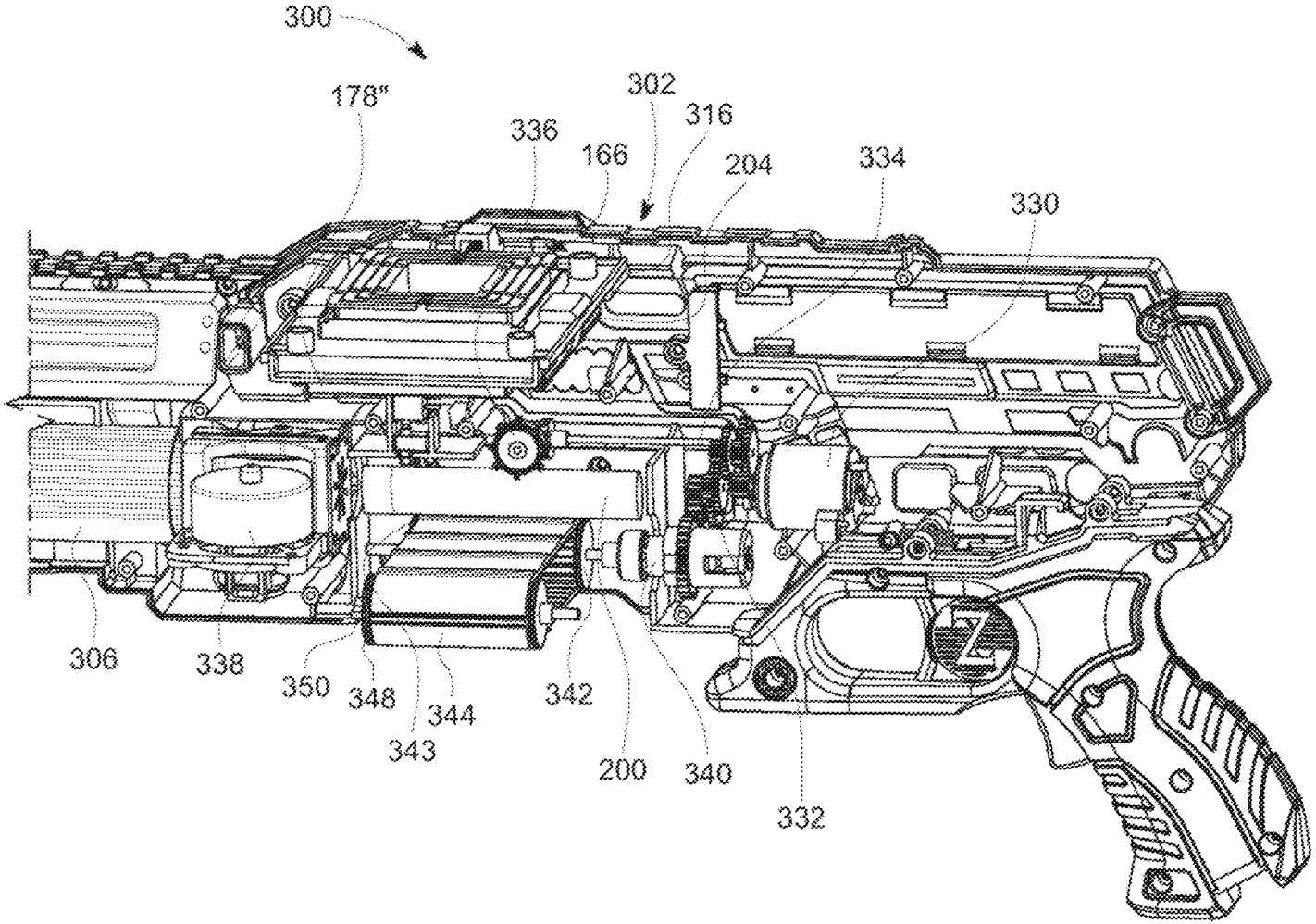
FIG. 28B shows a partial, perspective, side sectional view of a toy projectile launcher in accordance with additional exemplary embodiments of the present invention with a cutaway of the side of the housing of the launcher and portions of the detachable hopper to illustrate delivery of a dart from the hopper to the housing.

FIG. 28A shows a side, cross-sectional view of launcher 300. FIG. 28B shows a side view of launcher 300 with portions of the housing 302 and hopper 314 (including cover 316) removed. Referring to FIG. 28B, housing 302 includes a trigger 328, a battery-operated motor 330, gears 332, 336, 340, a shaft 334, and flywheels 338. In operation, when trigger 328 is pressed, power is provided to motor 330, which drives gear 332, which turns shaft 334. This turning of shaft 334 causes gear 336 to rotate. As gear 336 comes into contact with a dart 200, the rotation of gear 336 pushes dart 200 forward toward and in between two spinning flywheels 338, which propel the dart 200 down the barrel 306 and out of the muzzle 304 of launcher 300. (Only one of two flywheels 338 is shown in FIG. 28B. The second flywheel 338 is not shown because it is located directly behind the flywheel 338 that is shown.) When the hopper 314 is attached to housing 302 of launcher 300, gear 340 engages with a gear included in hopper 314 to move the darts 200 in the hopper 314 towards gear 336, as is described in more detail below.

A cross-sectional view of hopper 314 filled with darts 200 and cover 316 attached to housing 302 of launcher 300 is shown in FIG. 29. When hopper 314 is attached to housing 302, gear 340 of housing 302 (shown in FIGS. 21 and 28B) engages with gear 342 of hopper 314 (see FIG. 28B) and turns gear 342. (Gear 342 is not shown in FIG. 29 because it is located directly behind the gear 343 that is shown.) The turning of gear 342 (and gear 343) rotates rubber belt 344, so that rubber belt 344 delivers darts 200 from hopper 314 to a firing cavity in the housing 302. From that firing cavity, gear 336 (see FIGS. 21, 22, 28A, and 28B) pushes dart 200 forward toward and in between two spinning flywheels 338, as described above. The surface of rubber belt 344 may include ridges 346 to facilitate delivery of darts 200 from hopper 314 to the firing cavity in housing 302 of launcher 300 using the rubber belt 344.

Referring still to FIG. 29, the rotation of rubber belt 344 also rotates gear 348. A "propeller"-shaped structure 350 extends outwardly from the end of gear 348 and intermittently contacts the agitating member 352. Thus, as gear 348 turns counterclockwise, the propeller-shaped structure 350 intermittently kicks agitating member 352, thereby imparting a flapping motion to agitating member 352. The flapping of agitating member 352 agitates the darts 200 to facilitate their orderly descent within the hopper 314. The dart 200 nearest to the exit of hopper 314 will roll into the firing cavity of housing 302 and will be pushed forward by gear 336 (shown in FIGS. 21, 22, 28A, and 28B) toward and in between the two spinning flywheels 338, as described above.

Figure 30:
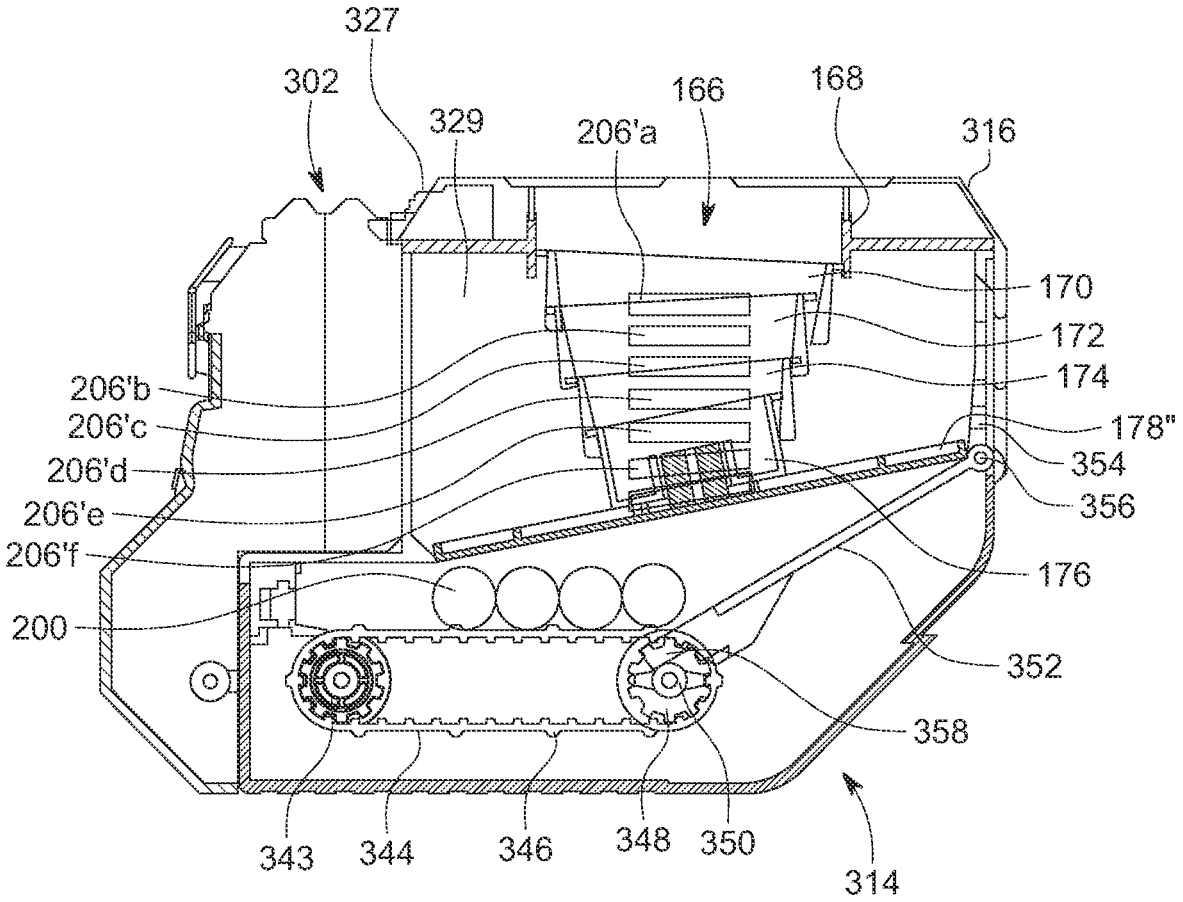
FIG. 30 shows a side cross-sectional view of the detachable hopper of FIG. 23 having relatively few toy projectiles (e.g., foam darts) remaining and a second possible position of a collapsible ceiling assembly which is attached to the underside of the cover of in accordance with additional exemplary embodiments of the present invention.
Figure 31:
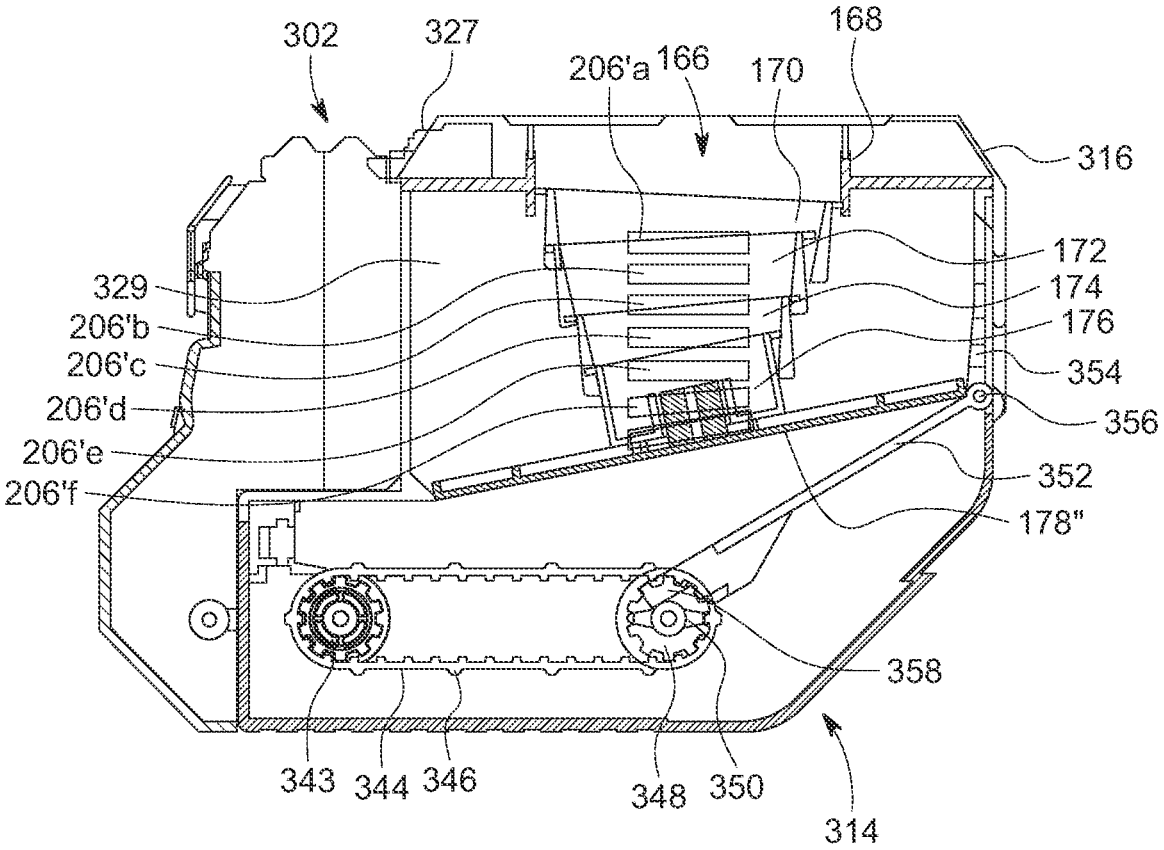
FIG. 31 shows a side cross-sectional view of the detachable hopper of FIG. 23 with no toy projectiles (e.g., foam darts) remaining and a third possible position of a collapsible ceiling assembly which is attached to the underside of the cover of in accordance with additional exemplary embodiments of the present invention.

In currently preferred embodiments, agitating member 352 may be a board that runs the width of the hopper 314. As shown in FIGS. 29-31, the agitating member 352 is rotatably coupled to a wall 354 by a hinge 356. Agitating member 352 includes two extended portions 358, one on each side of agitating member 352, which straddle the rubber belt 344. The extended portion 358 engages the propeller-shaped structure of gear 348 to impart a flapping motion to agitating member 352 as gear 348 rotates counterclockwise, as described above.

Detachable hopper 314 also includes collapsible ceiling assembly 166, which is attached to the underside of cover 316 by any suitable means. As shown in FIGS. 30 and 31 (and also in FIG. 14), collapsible ceiling assembly 166 includes nested members 168, 170, 172, 174, 176. Descending ceiling plate 178" of collapsible ceiling assembly 166 is attached to nested member 176 by any suitable means.

As a user fires darts 200 from launcher 300, the level of darts 200 inside hopper 314 drops. Nested members 170, 172, 174, 176 will drop further into the interior of hopper 314, in accordance with the drop in the level of darts 200 inside hopper 314, so that descending ceiling plate 178" remains atop the pile of darts 200 at all times when cover 316 is closed. FIGS. 29-31 illustrate three of the various different positions of nested members 168, 170, 172, 174, 176 within hopper 314 when cover 316 is closed on hopper 314. FIG. 29 illustrates one possible position of the nested members when hopper 314 is completely filled with darts 200. FIG. 30 illustrates a second possible position of the nested members when there are relatively few darts left in hopper 314. FIG. 31 illustrates a third possible position of the nested members when there are no darts left in hopper 314.

Figure 32:
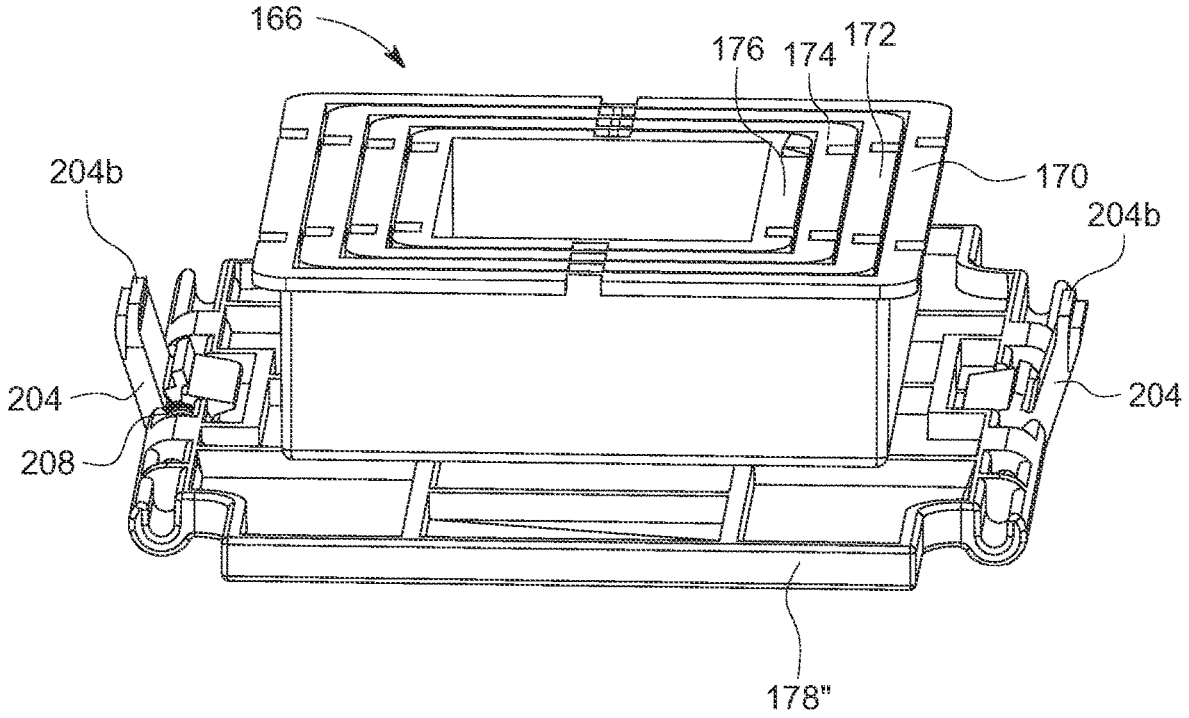
FIG. 32 shows a top perspective view of a ceiling plate attached to nested members of a collapsible ceiling assembly in accordance with additional exemplary embodiments of the present invention.

As shown in FIG. 32, ceiling plate 178" includes two catches 204 disposed on opposite sides of ceiling plate 178". Each one of the two catches 204 is coupled to ceiling plate 178" in essentially the same manner as described and shown above regarding the coupling of catch 204 to ceiling plate 178' (see FIGS. 13 and 14).

Each one of the two catches 204 respectively engages the openings/slots 206'*a*-206'*g* in opposite walls 329, 333 of detachable hopper 314 in the same manner described above in connection with catch 204 and openings/slots 206*a*-206*h* shown in FIGS. 12A-14 to prevent the ceiling plate 178" from collapsing up into the underside of cover 314 when launcher 300 is tilted, or placed upside down. If ceiling plate 178" could collapse upwards into the underside of cover 314, darts 200 will not be positioned correctly in hopper 314 and can no longer be agitated properly to move into the firing cavity of launcher 300.

Specifically, referring to FIGS. 29-31, when hopper 314 is full, descending ceiling plate 178" is collapsed into cover 316 and catches 204 are each located above the respective top openings 206'*a* on walls 329, 333 of hopper 314 as catches 204 may not be needed when hopper 314 is full to contain darts 200 in a desired position within hopper 314. However, as darts 200 are launched from launcher 300, ceiling plate 178" descends so that catches 204 engage the respective uppermost, first openings 206' a in walls 329, 333 of hopper 314. Then, when ceiling plate 178" further descends upon the launching of additional darts 200, catches 204 disengage from the respective first openings 206'*a* and engage the next lower opening 206'*b*. Next, ceiling plate 178" descends further when more darts 200 are launched, and catches 204 disengage from respective openings 206'*b* and engage openings 206'*c*.

This process continues for each consecutive lower opening 206'*d*, 206'*e*, 206'*f* of openings 206' until the darts 200 are greatly depleted from hopper 314, so that catches 204 are lowered to engage the lowest openings 206'*g* on walls 329, 333. As it descends between openings 206'*a*-206'*h*, front end 204*b* of each catch 204 rotates backward about its respective spring 208 (see FIG. 13). Catches 204 are restored to a biased position about their respective springs 208 when catches 204 enter one of their respective openings 206'*a*-206'*g*. Catches 204 are disengaged from whichever one of openings 206'*a*-206'*g* they are engaged in when movable rear wall assembly 124 cover 316 is opened.

As further shown in FIGS. 29-31, when there are relatively few darts (or no darts) left in detachable hopper 314, ceiling plate 178" no longer has a flat orientation within hopper 314 (as shown in FIG. 29). Instead, ceiling plate 178" assumes a sloping orientation within detachable hopper 314, wherein the end of ceiling plate 178" that is near wall 354 sits higher within hopper 314 than the end of ceiling plate 314 that is near housing 302 of launcher 300. For this reason, as shown in FIGS. 24-27 and 29, openings/slots 206'*f* and 206'*g* are each sloping with respect to openings/slots 206'*a*-206'*e* so that openings/slots 206'*f* and 206'*g* are each parallel to ceiling plate 178" as it assumes a sloping orientation near the bottom of detachable hopper 314. Otherwise, the catches 204 would not be able to engage the openings/slots 206'*f* and 206'*g* in respective walls 329, 333 as ceiling plate 178" nears the bottom of detachable hopper 314.

In accordance with embodiments of the present invention, a detachable hopper can be designed to have any size configuration or dimension and to hold any number of darts. In addition, body of the launcher is no longer tied to the shape or size of a detachable hopper and can become sleek-looking and aesthetically appealing.

A slimmer launcher body would require less plastic resin to produce and thus its production cost would be reduced. A slimmer launcher body would also result in a less bulky package, which would bring down transportation costs.

From the perspective of consumers, they could purchase extra detachable hoppers to have available as spare magazine clips so that they could continue to play for extended periods of time without the need to stop and reload a hopper with darts. In addition, when it becomes time to reload the detachable hopper, it is easier to load a small detachable hopper as compared to maneuvering an entire blaster to accomplish reloading.

In alternative embodiments, collapsible ceiling assembly 166 may include a lightweight extension spring instead of nested members 168, 170, 172, 174, 176. The extension spring may be coupled at one end to the underside of cover 116 or 316 and at its other end to descending ceiling plate 178 or 178' or 178". In such alternative embodiments, gravity again causes collapsible ceiling assembly 166 to expand as the spring extends into the interior of hopper 114 or 314 so that descending ceiling plate 178 or 178' or 178" again comes to rest on top of the pile of darts 200 housed in hopper 114 or 314.

As described herein, the embodiments in accordance with the present invention provide an elegant and economical solution to the problem of providing a toy projectile launcher, e.g., a toy foam dart launcher, that can launch a substantially large number of projectiles without reloading. While this invention has been described in conjunction with the embodiments outlined above, it is evident that many alternatives, modifications and variations will be apparent to those skilled in the art. Accordingly, the embodiments of the invention, as set forth above, are intended to be illustrative, not limiting. Various changes may be made without departing from the spirit and scope of the invention.

What is claimed is:

1. A toy projectile launcher, comprising:

a housing having an opening; and a hopper detachably coupled to the opening of the housing, the hopper configured to house one or more projectiles and to provide the one or more projectiles to the housing to be launched from the housing, wherein the hopper comprises:

a first wall and a second wall disposed opposite the first wall;

a cover having an underside which faces into the hopper;

a first plurality of openings in the first wall, wherein the first plurality of openings are spaced apart from one another and extend in substantial alignment from an upper position to a lower position on the first wall;

a second plurality of openings in the second wall, wherein the second plurality of openings are spaced apart from one another and extend in substantial alignment from an upper position to a lower position on the second wall;

a ceiling plate that is collapsibly attached to the underside of the cover and is expandable downward from the cover into the hopper when the cover is closed;

a first catch coupled to the ceiling plate and configured to engage with at least a first opening of the first plurality of openings when the hopper is loaded with a first amount of the one or more projectiles to prevent the ceiling plate from collapsing back into the underside of the cover when the cover is closed onto the hopper; and a second catch coupled to the ceiling plate and configured to engage with at least a first opening of the second plurality of openings when the hopper is loaded with the first amount of the one or more projectiles to prevent the ceiling plate from collapsing back into the underside of the cover when the cover is closed onto the hopper.

2. The toy projectile launcher of claim 1, wherein:

the first catch is further configured to disengage from the first opening of the first plurality of openings and engage with a second opening of the first plurality of openings located at a second position lower in the hopper than the first position when the hopper is loaded with a second amount of the one or more projectiles following a launch of one or more of the one or more projectiles from the hopper; and the second catch is further configured to disengage from the first opening of the second plurality of openings and engage with a second opening of the second plurality of openings located at a second position lower in the hopper than the first position when the hopper is loaded with the second amount of the one or more projectiles following a launch of one or more of the one or more projectiles from the hopper;

wherein the second amount of the one or more projectiles is less than the first amount that is loaded in the hopper.

3. The toy projectile launcher of claim 1, wherein at least one of the first catch and the second catch is coupled to the ceiling plate with a spring to allow engagement and disengagement of the at least one of the first catch and the second catch from one or more of the first plurality of openings and/or the second plurality of openings.

4. The toy projectile launcher of claim 1, wherein at least one of the first catch or the second catch is configured to disengage from any of the first plurality of openings and/or the second plurality of openings in which the at least one of the first catch or the second catch is engaged upon an opening of the cover of the hopper.

5. The toy projectile launcher of claim 1, wherein the ceiling plate is configured to rest on top of the one or more projectiles housed in the hopper.

6. The toy projectile launcher of claim 1, wherein the ceiling plate comprises a spring attached to the underside of the cover.

7. The toy projectile launcher of claim 1, wherein at least one of the first plurality of openings and the second plurality of openings are substantially vertically aligned.

8. The toy projectile launcher of claim 1, wherein at least one of the openings in the first plurality of openings has a sloping orientation.

9. The toy projectile launcher of claim 8, wherein at least one of the openings in the first plurality of openings near a bottom of the hopper has a sloping orientation.

10. The toy projectile launcher of claim 1, wherein at least one of the openings in the second plurality of openings has a sloping orientation.

11. The toy projectile launcher of claim 10, wherein at least one of the openings in the second plurality of openings near a bottom of the hopper has a sloping orientation.

12. The toy projectile launcher of claim 1, wherein the cover for the hopper is rotatably coupled to the hopper.

13. The toy projectile launcher of claim 1, further comprising a plurality of nested members between an interior side of the ceiling plate and the underside of the cover, wherein the plurality of nested members are extendible downward from the cover.

14. The toy projectile launcher of claim 1, further comprising an agitating member disposed between the first wall and the second wall and configured to facilitate an orderly descent of the one or more projectiles within the hopper.

15. The toy projectile launcher of claim 1, wherein the one or more projectiles comprise toy foam darts.

16. A toy projectile launcher, comprising:

a housing defining an interior recess; and a hopper detachably coupled to the interior recess of the housing, the hopper configured to house one or more projectiles and to provide the one or more projectiles to the interior recess of the housing to be launched, wherein the hopper comprises:

a first wall on a first side of the hopper, a second wall on a second side of the hopper opposite the first wall;

a cover having an underside which faces into the hopper;

a ceiling plate that is collapsible attached to the underside of the cover and is expandable downward from the cover into the hopper when the cover is closed;

at least one plurality of openings in the first wall or in the second wall, wherein the at least one plurality of openings are spaced apart from one another and extend in substantial alignment from an upper position to a lower position on the first wall or on the second wall;

at least one catch coupled to the ceiling plate and configured to engage with at least a first opening of the at least on plurality of openings when the hopper is loaded with a first amount of the one or more projectiles to prevent the ceiling plate from collapsing into the underside of the cover when the cover is closed onto the hopper;

a rotating belt to deliver the one or more projectiles to the interior recess of the housing; and an agitating member disposed between the first wall and the second wall and rotatably coupled to the hopper, wherein rotation of the rotating belt imparts a flapping motion to the agitating member.

17. The toy projectile launcher of claim 16, wherein the agitating member straddles the rotating belt.

18. The toy projectile launcher of claim 17, wherein:

the interior recess of the housing includes a firing chamber; and the rotating belt delivers the one or more projectiles into the firing chamber.

19. The toy projectile launcher of claim 18, wherein the firing chamber comprises a rotating gear to advance the one or more projectiles from the firing chamber.

20. The toy projectile launcher of claim 16, wherein the flapping motion of the agitating member agitates the one or more projectiles within the hopper.

21. The toy projectile launcher of claim 20, wherein the flapping motion of the agitating member facilitates an orderly descent of the one or more projectiles within the hopper.

22. The toy projectile launcher of claim 16, further comprising a gear coupled to the rotating belt, wherein the gear includes a structure that extends outwardly from an end of the gear.

23. The toy projectile launcher of claim 22, wherein the structure that extends outwardly from the end of the gear contacts the agitating member intermittently to impart the flapping motion to the agitating member.

24. The toy projectile launcher of claim 16, wherein the one or more projectiles are to be provided to the interior recess of the housing one at a time.

25. The toy projectile launcher of claim 16, wherein the agitating member is rotatably coupled to the hopper by a hinge.

26. The toy projectile launcher of claim 16, wherein the one or more projectiles comprise toy foam darts.

27. The toy projectile launcher of claim 16, wherein the at least one plurality of openings comprises:

a first plurality of openings in the first wall, wherein the first plurality of openings are spaced apart from one another and extend in substantial alignment from an upper position to a lower position on the first wall; and a second plurality of openings in the second wall, wherein the second plurality of openings are spaced apart from one another and extend in substantial alignment from an upper position to a lower position on the second wall.

28. The toy projectile launcher of claim 27, wherein the at least one catch comprises:

a first catch coupled to the ceiling plate and configured to engage with at least a first opening of the first plurality of openings when the hopper is loaded with a first amount of the one or more projectiles to prevent the ceiling plate from collapsing back into the underside of the cover when the cover is closed onto the hopper; and a second catch coupled to the ceiling plate and configured to engage with at least a first opening of the second plurality of openings when the hopper is loaded with the first amount of the one or more projectiles to prevent the ceiling plate from collapsing back into the underside of the cover when the cover is closed onto the hopper.

29. A hopper for a toy projectile launcher, comprising:

a first wall;

a second wall disposed opposite the first wall;

a cover having an underside which faces into the hopper;

a ceiling plate that is collapsibly attached to the underside of the cover and is expandable downward from the cover into the hopper when the cover is closed;

at least one plurality of openings in the first wall or in the second wall, wherein the at least one plurality of openings are spaced apart from one another and extend in substantial alignment from an upper position to a lower position on the first wall or on the second wall; and at least one catch coupled to the ceiling plate and configured to engage with at least a first opening of the at least one plurality of openings when the hopper is loaded with a first amount of the one or more projectiles to prevent the ceiling plate from collapsing back into the underside of the cover when the cover is closed onto the hopper.

30. The hopper of claim 29, wherein the at least one plurality of openings comprises:

a first plurality of openings in the first wall, wherein the first plurality of openings are spaced apart from one another and extend in substantial alignment from an upper position to a lower position on the first wall; and a second plurality of openings in the second wall, wherein the second plurality of openings are spaced apart from one another and extend in substantial alignment from an upper position to a lower position on the second wall.

31. The hopper of claim 30, wherein the at least one catch comprises:

a first catch coupled to the ceiling plate and configured to engage with at least a first opening of the first plurality of openings when the hopper is loaded with a first amount of the one or more projectiles to prevent the ceiling plate from collapsing back into the underside of the cover when the cover is closed onto the hopper; and a second catch coupled to the ceiling plate and configured to engage with at least a first opening of the second plurality of openings when the hopper is loaded with the first amount of the one or more projectiles to prevent the ceiling plate from collapsing back into the underside of the cover when the cover is closed onto the hopper.

32. The hopper of claim 31, wherein:

the first catch is further configured to disengage from the first opening of the first plurality of openings and engage with a second opening of the first plurality of openings located at a second position lower in the hopper than the first position when the hopper is loaded with a second amount of the one or more projectiles following a launch of one or more of the one or more projectiles from the hopper; and the second catch is further configured to disengage from the first opening of the second plurality of openings and engage with a second opening of the second plurality of openings located at a second position lower in the hopper than the first position when the hopper is loaded with the second amount of the one or more projectiles following a launch of one or more of the one or more projectiles from the hopper;

wherein the second amount of the one or more projectiles is less than the first amount that is loaded in the hopper.

33. The hopper of claim 29, wherein at least one of the first catch and the second catch is coupled to the ceiling plate with a spring to allow engagement and disengagement of the at least one of the first catch and the second catch from one or more of the first plurality of openings and/or the second plurality of openings.

34. The hopper of claim 29, wherein at least one of the first catch or the second catch is configured to disengage from any of the first plurality of openings and/or the second plurality of openings in which the at least one of the first catch or the second catch is engaged upon an opening of the cover of the hopper.

35. The hopper of claim 29, wherein the ceiling plate is configured to rest on top of the one or more projectiles housed in the hopper.

36. The hopper of claim 29, wherein the ceiling plate comprises a spring attached to the underside of the cover.

37. The hopper of claim 29, wherein at least one of the first plurality of openings and the second plurality of openings are substantially vertically aligned.

38. The hopper of claim 29, wherein at least one of the openings in the first plurality of openings has a sloping orientation.

39. The hopper of claim 38, wherein at least one of the openings in the first plurality of openings near a bottom of the hopper has a sloping orientation.

40. The hopper of claim 29, wherein at least one of the openings in the second plurality of openings has a sloping orientation.

41. The hopper of claim 40, wherein at least one of the openings in the second plurality of openings near a bottom of the hopper has a sloping orientation.

42. The hopper of claim 29, wherein the cover for the hopper is rotatably coupled to the hopper.

43. The hopper of claim 29, wherein the ceiling further comprises a plurality of nested members, between an interior side of the ceiling plate and the underside of the cover, wherein the plurality of nested members are extendible downward from the cover.

44. The hopper of claim 29, further comprising an agitating member disposed between the first wall and the second wall and configured to facilitate an orderly descent of the one or more projectiles within the hopper.

45. The hopper of claim 29, wherein the one or more projectiles comprise toy foam darts.

* * * * *